US007347712B2

(12) United States Patent
O'Connell et al.

(10) Patent No.: US 7,347,712 B2
(45) Date of Patent: Mar. 25, 2008

(54) SAFETY COVERS FOR ELECTRIC SOCKETS AND THE LIKE

(75) Inventors: Ian O'Connell, London (GB); Michelle Clare O'Connell, London (GB); Michael Ioannou, London (GB)

(73) Assignee: Dormina UK Limited, Hampstead, London (GB)

( * ) Notice: Subject to any disclaimer, the term of this patent is extended or adjusted under 35 U.S.C. 154(b) by 0 days.

(21) Appl. No.: 10/543,351

(22) PCT Filed: Jan. 27, 2004

(86) PCT No.: PCT/GB2004/000256

§ 371 (c)(1),
(2), (4) Date: Mar. 24, 2006

(87) PCT Pub. No.: WO2004/068647

PCT Pub. Date: Aug. 12, 2004

(65) Prior Publication Data

US 2006/0223358 A1 Oct. 5, 2006

(30) Foreign Application Priority Data

| | | |
|---|---|---|
| Jan. 27, 2003 | (GB) | 0302411.4 |
| Jan. 27, 2003 | (GB) | 0302412.2 |
| Jan. 28, 2003 | (GG) | 0301903.1 |
| Oct. 23, 2003 | (GB) | 0325676.5 |
| Oct. 23, 2003 | (GB) | 0325677.3 |

(51) Int. Cl.
*H01R 13/62* (2006.01)

(52) U.S. Cl. ..... 439/373

(58) Field of Classification Search ..... 439/373, 439/536, 535, 133, 135, 136, 140–142, 372, 439/134; 174/48–49, 101, 66–67, 480, 488
See application file for complete search history.

(56) References Cited

U.S. PATENT DOCUMENTS

| | | | | |
|---|---|---|---|---|
| 4,163,882 | A * | 8/1979 | Baslow | 200/296 |
| 4,424,407 | A * | 1/1984 | Barbic | 174/67 |
| 5,000,696 | A * | 3/1991 | Matsuoka et al. | 439/331 |
| 5,243,135 | A * | 9/1993 | Shotey | 174/67 |
| 5,556,289 | A | 9/1996 | Holbrook, Jr. | 439/135 |
| 6,159,034 | A | 12/2000 | Royer | 439/373 |
| 6,699,060 | B1 * | 3/2004 | Scott | 439/373 |

FOREIGN PATENT DOCUMENTS

| | | |
|---|---|---|
| GB | 2277833 | 11/1994 |
| GB | 2362765 | 11/2001 |
| GB | 2366457 | 3/2002 |

* cited by examiner

*Primary Examiner*—Edwin A. Leon
(74) *Attorney, Agent, or Firm*—Polster, Lieder, Woodruff & Lucchesi, L.C.

(57) ABSTRACT

An electrical socket assembly includes a plurality of pin receiving apertures passing through a wall mounted face-plate. The faceplate is enclosed by an integral cover panel which is spring biased to an open position. Engaging latch pins and a latch mechanism secure the integral cover panel in a closed position, and are adapted to be released in response to the insertion of a key into keyholes disposed in the side of the faceplate.

20 Claims, 36 Drawing Sheets

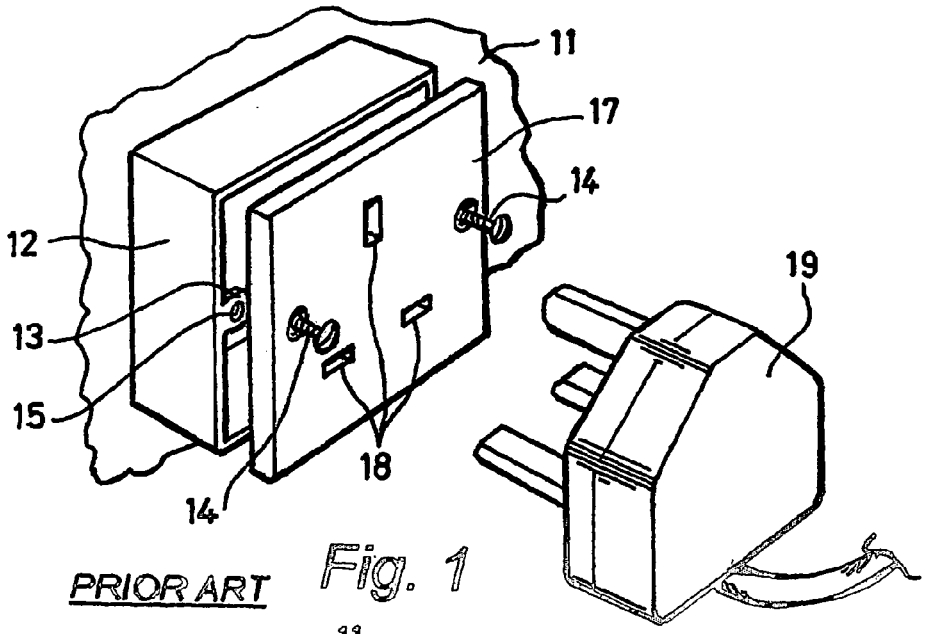
PRIOR ART Fig. 1
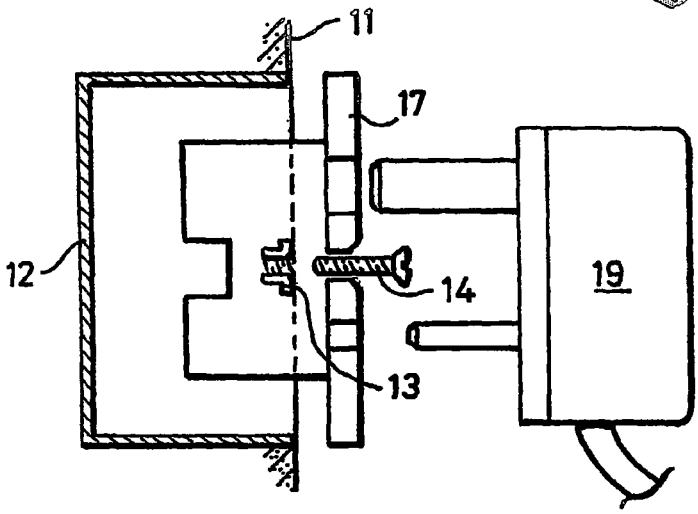
Fig. 2
PRIOR ART
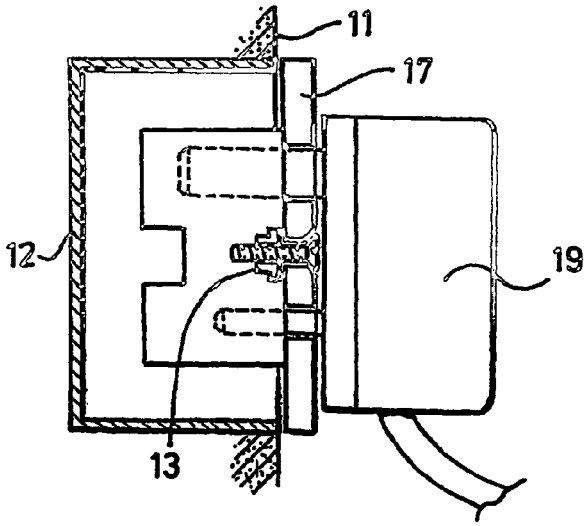
Fig. 3
PRIOR ART

SAFETY COVERS FOR ELECTRIC SOCKETS AND THE LIKE

RELATED APPLICATIONS

This application derives and claims priority from International Application PCT/GB2004/000256, filed Jan. 27, 2004, and published under International Publication Number WO 2004/068647 A1, and from British Applications GB0302411.4 filed Jan. 27, 2003, GB0302412.2, filed Jan. 27, 2003, GB0301903.1 filed Jan. 28, 2003, GB0325676.5 filed Oct. 23, 2003, and GB0325677.3 filed Oct. 23, 2003.

BACKGROUND OF THE INVENTION

This invention is concerned with safety covers and relates in particular, but not exclusively, to a protective cover for a switch or a socket (and for a plug when in that socket) such as may be used for providing electricity or a telephone, video or data connection.

In modern electrical systems as used in houses, offices and other buildings, electricity is delivered by cabling to various points around the building at which there are electric sockets with faceplates into which appliances to be powered using the electricity supply can be plugged. Such sockets may be unswitched or switched so that the power supply to appliances plugged into the sockets can be controlled without unplugging the appliance. Moreover, in a modern building there will be a technically similar system for providing communication channels—for telephone, television and computer.

Each of the sockets will usually be of the type having an apertured terminal-carrying socket faceplate mountable on a recessed socket box itself flush mounted within a cavity in or on a wall. The apertures lead to the socket's terminals, disposed on the back of the plate and thus out of harm's way inside the box, and are shaped and sized to match the contact pins of the plug for which the socket is designed.

Another type of socket commonly encountered, especially in electric power circuits, is the "extension socket" where a group of two or more individual sockets are arranged in a box-like carrier and connected by a single lead to a plug that plugs into a single wall-mounted socket (in this way a single such wall socket can, within reason, be "converted" into a plurality of sockets). Such an extension socket device normally has the appropriate plurality of apertured terminal-carrying socket plates mounted on a socket box. In principle, therefore, it is little different from a wall-mounted socket.

There are many reasons why it might be desirable to provide a cover over a socket, or over a plug when in place in that socket. One is that empty sockets seem to exert an irresistible fascination for small children, who will try to poke their fingers, their toys, or any available long thin object—such as a knitting needle or a screwdriver—into the plug pin apertures in the socket; when applying such investigative skills to an electric socket a persistent and inventive child may well be successful, but sadly the reward for such success is all too often death by electrocution.

Another reason is that much modern equipment is designed to be plugged in and left on and connected all the time—falling into this category are refrigerators, televisions (and video recorders) and Fax machines at one extreme, and computers (and their networks) and medical life support systems at the other—and sometimes it may be a minor disaster if the device is disconnected, unplugged or turned off (by, for example, a cleaner looking for a socket into which to plug a vacuum cleaner).

The problem, as always, is how to achieve a cover that is both effective, securely hiding the switch, socket or plug from an inquisitive child or a careless cleaner, and yet also relatively easy for an authorised person to remove in order to access the plug, or the socket and its switch.

One solution for an empty socket is to insert into it an imitation plug with a shallow head that a child's fingers cannot easily grip. Such a solution does not help with the secondary problem of preventing a used socket being switched off, or having the plug removed from it. To deal with this problem, box-like covers that can be secured over the plug-carrying socket so as to prevent access to the plug are known. However, none of these covers is especially convenient—or, sometimes, terribly effective.

It is an object of the present invention to provide a cover that is simpler and easier to use whilst at the same time providing the required secure protection.

Thus, according to the present invention, there is provided a socket (or switch) having an integral (built-in) cover with a cover panel movable between open and closed positions.

The invention has application to sockets with pin receiving apertures for a plug where it may be desirable to conceal a front surface of the face plate provided with pin receiving apertures for a plug and/or a switch, for example to prevent equipment being inadvertently switched off.

By this invention, an existing unprotected socket (or switch), ie a socket having free access to the pin receiving apertures and/or to a plug received therein can be replaced by a protected socket with integral cover such that access to the pin receiving apertures and/or a plug received therein can be restricted by securing the cover panel in the closed position. Such protected socket according to the invention can also be used for new build or when extending an existing electrical circuit.

In some embodiments the socket (or switch) comprises a face plate and integral means by means of which the cover panel is mounted for movement between a closed position concealing a surface of the face plate and an open position allowing access to the surface.

The socket plate may be detachably attached to a mounting box which may be wall mounted (either recessed or face fixed) or freestanding (an extension lead).

The integral means for mounting the cover panel may be formed integrally with the socket, for example by moulding, or formed separately and permanently secured thereto, for example by adhesive or non-releasable fasteners.

In a preferred arrangement, the cover has a frame integral with the faceplate, and the cover panel movably mounted with respect to the frame between the closed position, where it completely covers and encloses the faceplate (and any plug or switch), and the open position, allowing access thereto. The frame may extend around the marginal edge of the faceplate.

Preferably, latch means is provided for holding the cover panel closed, and actuator means enabling the cover panel to be released. The latch means is preferably self-latching to secure automatically the cover panel on movement of the cover panel to the closed position.

Preferably, the cover panel is movable towards the closed position against a biasing force that urges the cover panel towards the open position such that the cover panel can move to the open position on being released.

The integral (built-in) cover of the invention is for the protection of switches and sockets (and plugs mounted therein). For simplicity hereinafter the term "socket" is used, where possible and where the context allows, to mean both an actual socket, such as a telephone, television, computer or electrical socket, into which a plug can be operatively inserted, and also a switch (it is common for certain electric systems, such as night-storage heater systems, to use switches which are physically much like a switched socket but without the socket parts). If a particular reference is necessary to switches, then it is given positively.

The socket to be protected may be almost any of the designs used throughout the world ranging from 2-round-pin recessed devices used over most of continental Europe and Russia, through the 2-flat-strip US ones, the present-day UK "triangle" 3-square-pin ones, the triangle 3-round-pin Indian ones, 3-in-a-line-round-pin Italian ones and the triangle 2-strip-one-round Japanese ones, up to the proud triangle 3-angled-strip-pin sockets used in Argentina, Australia and China.

All such known socket systems are of the type that carry a faceplate, which is attached by means of threaded screws extending through the plate into threaded apertures near the periphery of the mounting box, and thus can be provided with a cover of this invention, though, like the socket faceplates themselves, the covers may only be superficially similar visually.

The invention provides an integral cover for the socket—that is to say, a cover which, when in place, may prevent prying fingers and other objects being poked into the socket's terminal apertures, and will prevent a plug in the socket being removed therefrom. As is discussed in more detail hereinafter, the cover is lockable—that is, when closed and held in place it needs an actuator such as a key or key-like device to unlock it before it can be opened.

The socket with integral cover of the invention may have pin receiving apertures in the socket plate (otherwise referred to as a front or faceplate) removably mountable onto a socket mounting box (typically such a box being recessed into and flush mounted within a cavity in a wall) so that the apertures lead to the socket's terminals disposed on the back of the plate and thus inside the box. It is usual for the plate to fit onto the box and be held there using a number of screw-headed bolts, typically two, extending through the faceplate into threaded apertures near the periphery of the box.

Sockets often come in pairs—that is to say, two sets of plug-pin-apertures disposed side-by-side in a double-length socket plate (with matching socket box). Indeed, on occasion the socket might even be a triple socket (or more!). The socket with integral (built-in) cover of the invention may cater for this by its base being matchingly sized to the box-housing frame, and, by having its cover panel extending, to cover all the plug-pin aperture sets and any plugs or jacks inserted thereto.

The socket (or switch) with integral (built-in) cover has a frame mountable to the socket mounting box (or to the wall)—that is to say, against and in contact with the box/wall surface, so leaving no significant gap through which an object might be poked into the socket. The frame preferably extends around the perimeter of the socket plate and the cover panel conveniently matches the plate in shape and size, being just large enough to allow a plug or plugs to fit within it when in the closed position.

Where the socket with integral (built-in) cover is a plug-bearing socket, some means by which the plug's flex, lead or cord can extend away from the plug and socket may be provided. This is most conveniently achieved by providing a suitable slot in that edge of the frame which will, in use, be on the side of the socket from which the lead of a plug in the socket will project (this is usually the bottom edge for socket and plug designs in the UK, or in the centre for many of the socket designs employed in Europe, Asia and America, though obviously a socket can be installed any way up!). The slot can be simply wide enough to house the lead, or it can be the entire width of that side of the frame (so that the frame becomes a three-sided rather than four-sided when used with a faceplate of rectangular shape).

A variation of the invention can be found for use with freestanding extension sockets. In this arrangement the faceplate and integral (built-in) cover may be attached to a base plate and these extension sockets can include any or all of the following components incorporated onto the base plate—one or more outlets (pin receiving apertures) for electrical plugs, one or more outlets for co-axial cable jacks, and one or more outlets for telephone, facsimile or modem plugs. The extension unit can be connected to its power or data source by way of an electrical or data cable, employing a suitable plug to fit and draw power or data from that connection source.

As will be understood, the socket with integral (built-in) cover of the invention can replace the conventional apertured terminal-carrying socket plate (otherwise referred to as a front or socket faceplate) that is removably mountable on the base plate of such extension leads. The cover (or covers) can be affixed to any part of the extension unit such that they will still provide all of the functionality as described above, and can be secured in the closed position to allow the covers for any part of, or all of the unit's outlets, to be either fully shrouded and inaccessible or exposed and therefore accessible for use thereto.

The cover panel may be hingedly secured to the frame, and swingable between a closed position, where it completely covers and encloses the socket and any plug therein, and an open position, where it is clear therefrom, allowing access thereto. Alternatively, the cover panel can achieve the same functionality by being slidably secured to the frame by a means of clipping onto parallel grooves, or runners (much like a train to a track). Though notionally the panel could be of any shape and size, most preferably it matches the socket it is to be used with, as does the faceplate frame. Thus, it will generally be roughly rectangular—square or oblong.

On its side against which the cover panel fits the frame (that is to say, in most cases, the side where the panels hinges or runners are positioned) there may be a low, upstanding perimeter wall which projects sufficiently to cover and so hide the actual touching faces of the framed faceplate and panel. This makes it harder for inquisitive fingers to poke themselves, or some other tool, into the socket between the panel and the faceplate.

The cover panel may, like the cover as a whole, be made of any convenient material—typically a plastic such as polyethylene or polypropylene or glass reinforced polycarbonate. Most preferably, though, at least for the area that overlies the socket's switches the cover is made of a transparent material—for example Perspex—so that the state of the switches may easily be seen without first having to open the cover.

It is convenient for any embodiment of the invention if both the cover frame and cover panel be associated with a sealing gasket—preferably an appropriately-shaped "ring" of a rubber or some similar flexible insulating material—so that when the frame is fitted, there is an effective seal between the frame's back-plate and the wall to which it is fitted, and when the cover panel is shut, it seals fairly tightly against the frame's surface, so assisting (with the frame's boundary wall) to keep steam, water, prying fingers or other spilt liquids and vapours away from the plug. The gaskets can be mounted in or on either of the frame and the panel. The former is preferred.

It is similarly convenient, if the faceplate frame and wall be associated with a sealing gasket—preferably an appropriately-shaped "ring" of a rubber or some similar flexible insulating material—so that, when the frame is mounted to the socket mounting box by means of tightening the threaded screws, there forms an effective seal between the wall and the frame's surface, so assisting (with the frame's boundary wall) to keep both prying implements, steam, vapours and/or spilt liquids away from the gap between the wall and the frame. The gasket can be mounted in a groove shaped into the reverse side of the faceplate or frame, the former being preferred.

Hinging movement of the cover panel may be accomplished in any convenient manner—using real, separate, hinges, say, or merely making the panel an integral part of the frame but joined thereto by some thin, flexible web of material that allows the cover panel to bend—to hinge—back and forth relative to the frame.

The hinging may be arranged in such a way that when the cover latches are released from their retaining members, that the cover panel could not be conveniently opened far enough to allow easy access to the plugs or sockets housed therein. One preferred way, though, is to mount the cover panel by way of pivot pins on one of the panel and frame that are received in corresponding pivot holes in the other of the panel and frame. Such hinge mounting is often utilised for the doors of refrigerators and microwave ovens.

The cover panel may be hinged anywhere along its periphery that is appropriate. A rectangular cover panel can be hinged on any of its sides and may conveniently be hinged on one of its (in-use) vertical sides. When deploying the invention for use with continental socket and plug arrangements where the plug and cable extend from the middle, rather than the base of the socket, a pair of cover panels may by employed that open from the middle outwards and allow passage of the cable or lead through the cover panel(s) in the closed position. For UK plug and socket arrangements in particular, there may well be some advantage in hinging it along its (in-use) top edge, so that it opens upwards, away from the plug's lead (this facilitates inserting and extracting the plug).

The hinging movement is preferably spring-loaded in the opening direction so that the cover panel must be pushed shut against the force of the spring (or springs), and automatically springs open when the panel is released.

Where the panel is to be closable with the plug in the socket, then the panel is preferably either hung far enough away from the socket plate or is so shaped to provide room for the plug behind the panel when it is closed. Were the frame to be sufficiently deep then it could extend away from the wall/socket box a distance greater than the depth of the plug, and then a cover panel mounted on the wall-distant surface of the frame would leave room for the plug behind it even when closed.

However, a rather shallower, less bulky frame is preferred, in which case the cover panel is preferably shaped, for example with an outward bulge, to leave room for the plug. Any suitable shape may be employed—a square box shape, for example—but aesthetically it is preferable to provide the panel with a central domed portion wide and deep enough to accommodate the plug. Where the socket/plug to be covered is a double (or greater) socket, as mentioned previously, the shaped part of the panel may either be a single bulge extending sufficiently to overlay all the plug-pin holes, or more preferably, it may have a number of separate bulges, one for each set of plug-pin holes.

The cover panel may be designed to allow it to be removed and replaced if necessary or desirable, for example if broken, say, or perhaps merely to match a different colour scheme. One convenient way of achieving relatively simple replaceability whatever material the panel is made from—typically a plastic such as polyethylene or polypropylene—is to secure the panel with hinge pins that can be detached by tapping the pins out of their hinge knuckles to free the cover panel from the frame. The replacement panel can then be fixed by aligning the corresponding hinge knuckles found on both the frame and the cover panel and tapping the hinge pins back into the knuckles.

The socket with integral (built-in) cover of the invention has latch means for holding the cover panel closed. The latch means may take any suitable form, and could, for example, comprise a catch part on one of the cover panel and frame engaging with a retainer part on the other of the cover panel and frame. One part may be on or adjacent an edge of the cover panel engaging with the other part on or in the frame, conveniently—in the case of a hinged cover panel—in that portion opposite the hinged edge.

One preferred form of the latch means is the combination of a detent and a matching notched, toothed or headed pin, the pin projecting from the inside surface of the cover panel, at its edge, into a hole in the frame behind which is the detent to prevent it coming back out until the detent is withdrawn and the pin released.

In another preferred form there is also utilised something like a pin/detent arrangement, but the other way around; projecting in from the panel is a seared pin which engages with a detent on/inside the frame, and can only be disengaged by physically pushing the pin (against its natural resilience) to one side until its sear clears the detent and so allows the panel to open.

The socket with integral (built-in) cover of the invention preferably also has key-operated means to release the latch means enabling the cover panel to be secured, against unauthorised opening, when in the closed position. The key-operated means may also include locking means for added security which may take any convenient form, being for example a mortice-type lock, or even a numbered combination lock. The lock may also be electromagnetic, requiring the use of at least two appropriately charged magnets to operate the lock and opening function.

It is particularly preferred however that the locking means is combined with the latch means, and that the combination be a pin-and-detent latch (as just described above) with key operation to withdraw the detent and so release the pin, or to push the pin clear of the detent, and thus permit the cover to open. The key may be a mortice-type key, its key-bit operatively engaging with a bolt-like detent (say). More preferably, however, for use with the integral (built-in) cover of the invention, it is particularly advantageous to have a design that allows a number of rather different types of lock arrangement, according to the circumstances of manufacture and use.

In one such type—a seared pin/fixed detent version—there is not just a single pin/detent arrangement but rather a double one, spaced apart, necessitating a double rod-like driver that can press against, and so push aside both seared pins at the same time (this makes it less likely that a young, adventurous child with a knitting needle will be able to probe the cover until it opens!). This requires a two-pronged key, the spaced prongs of which are themselves the double rod-like driver and have to be simultaneously inserted through corresponding spaced keyhole apertures aligned with the pins.

Moreover, to make it harder for a child to operate improperly, the keyhole apertures can have a spring-loaded shutter on their inner side which must first be pushed aside by the key's prongs—or, preferably, by a third (central) prong dedicated to the purpose—before the prongs can reach further into the arrangement to "unlock" the panel. Further, to provide an even greater measure of security, in a position between the seared release pins and the keyhole apertures, there can be a combination lock device in which apertured discs are rotated, such that in order to unlock the cover, it is necessary to align the combination disc apertures with the key hole apertures and so enable the key prongs to pass through.

In another type, a retaining member or projecting toothed detent is positioned at the tip of a 'flexing arm' and attached to the socket or base-plate within the plane of the lock barrel and positioned so that the tip of the arm engages with a matching toothed detent or retaining member attached to the underside of the cover panel as it is closed. With the cover panel in the closed position, the toothed detent is fully engaged with the retaining member of the cover panel, effectively holding the cover panel in the closed position against the tension of the torsion spring located at the hinge point of the cover panel.

To open the cover, a key of predetermined shape is inserted into the barrel. The locking mechanism is accessed by key via the lock aperture located on any of the edges except for the edge along which the hinges are displaced. For the purpose of the following description, the projecting detent is located on the arm and the retaining member on the underside of the cover.

In order for the detent to be released from its retaining member, the arm is moved away, or 'flexed' apart from its retaining member. This can be achieved by a key with a twisting motion so that, as the key is turned in the lock, the circumference of the twisting key blade extends into and beyond the crook of the arm to move the 'flexing' arm and its toothed detent away from the retaining member. The cover panel opens by virtue of the tension from the torsion spring mounted along its hinge.

Once the key is withdrawn, the 'flexing' arm springs back to its original position, allowing the retaining clasp to once again engage with the cover panel detent when the cover panel is next closed. The strength of resistance and extent of movement of the arm is governed by both the shape of the arm and the choice of material used in its manufacture. The thinner the arm, and the greater the elasticity of material used to manufacture the arm, the less resistance against movement and the greater the spring effect of the movement will be. Most conveniently, the arm can take the approximate shape of the capital letter "U" split into two equal parts along its vertical axis. The projecting detent will be positioned at the tip of the longer edge.

In order for this type of action to function, the arm can be manufactured from a material with properties that allow it to flex or bend, yet faithfully retains memory of its original shape and position despite repeated movement or flexing. Such material could include steel or aluminium, but preferably polymers such as acetal (polyoxymethylene) and/or other thermoplastics such as Delrin (formed by polymerising formaldehyde and acetate) or Celcon (formed by polymerising trioxene and cyclic) can be used.

Preferably, the mechanism will allow the release of the detent by rotation of the key to a maximum of 33 degrees. This will ensure that both the key fob and the user's hand operating the key avoids interfering with the wall during rotation.

This mechanism suffices for just a single latching or locking point. The advantages this particular design offers include; a simple and low cost of manufacture on account of the absence of moving parts, quick assembly by the use of just two extra parts [separate to the base-plate or cover moulding] being a self tapping screw to secure the arm to the base plate; a locking mechanism which deploys a unique key barrel not easily 'picked' by every day items such as other keys, screwdrivers and the like; and a key operation that requires a maximum turn of only 33 degrees.

In another embodiment, the locking action can be achieved by deploying a combination of a spring loaded toothed detent extending from the frame of the base plate, engaging with a matchingly sized opening within a retaining member (or plate) extending from the underside of the spring-loaded cover. The retaining pin protrudes from a rotating hinge axle located in the lock area, and attached to the base plate using a sprung pin, much like an axle can be attached to a wheel.

This design is best deployed for use of a key with a twisting action and in circumstances desirable to control force required to open by the use of spring loaded tension applied to the rotating axle, whereby control of the counter rotation required of the axle to unlock the cover is controlled by a suitable key.

The locking mechanism takes the appearance of a T-shaped axle. The horizontal axis serves as the rotating hinge, one end being attached at a perpendicular angle to the inside of the outer perimeter wall of the base plate, at the entrance of the locking shaft, while the opposite end is mounted through and secured to the inside perimeter wall using a sprung pin. The vertical axis consists of a retaining shaft pin with a toothed detent at its tip.

The head of the detent can be of any shape but most conveniently, is shaped to give the appearance of an elliptical cam spliced in equal halves along the vertical. As the cover is closed, the angle of motion causes the retaining member to engage with the curved surface of the clasp's cam shaped head. The force of the retaining plate pushes back the shaft pin to counter rotate on its axle and the cam head to slide along the front face of the retaining plate until the angular plane of the cam engages with the opening in the retaining plate, whereby the cam fully engages and clasps the retaining plate, rendering the cover closed and locked against unauthorised entry.

The retaining plate is released to allow the cover panel to open by using a key that is shaped to engage with the axle hinge in such a way, that as the key is turned in a counter direction to the spring loading, so the shaft pin and clasp tilt backwards and away from the cover retaining plate, disengaging and so allowing the cover panel to spring open.

Though superficially similar to the cover leg pins described in the other locking mechanisms previously, the width of the single pin shaft neck is considerably wider and the depth of the retaining clasp greater. The clasp's greater surface area engaging with the opening in the retaining plate is designed to provide the locking cover with greater security and robustness to resist forced opening.

One particular advantage of this design is the simplicity with which the key and rotating axis can be individually shaped so that locks are unique to particular models of socket covers, thus significantly enhancing security in circumstances where needed. Either the key or the axle can be 'male' or 'female', according to the preference of the user. A male axle would require a female key and vice versa.

Another advantage is the reduction in the number of different parts needed to complete the locking mechanism compared to a regular metal barrel and key arrangement. A single moulded part comprises the shaft pin with the toothed detent and rotating axis. The axle spring can be a conventional metal torsion spring mounted to the axle, or be an extension to the entire axle mould.

By using a polymer with flexing and memory properties similar to those described in the 'flexing' arm lock described above, the axle can have a 'sprung tail' extending from the bottom of the shaft pin on the opposite side to the toothed detent. The sprung tail offers similar operational functionality to the metal axle spring. Overall, the design with fewer parts provides for a simpler and more reliable operation that is less expensive to produce and assemble into a working model.

In all cases such locks can be disposed for access from any "side"—top, bottom or left side or right side—of the cover panel, its parts being mounted within the frame and the holes for the prongs of the key being in the side surface of the frame and essentially invisible from the front. The keyholes and or any numbered combination lock are most preferably outlined in luminous paint so that they show up in the dark and, where the frame is particularly slim, it may be necessary to angle the holes and the internal parts such that the key can be inserted in a direction angled towards the wall in which the socket is mounted.

In a preferred arrangement, at least two latches are provided for latching the cover panel to the frame, wherein engagement and disengagement of the first latch is in a direction different to that of the second latch. In this arrangement, engagement of disengagement of the latches occurs in sequence and when closed, both latches have to be release before the cover panel can move freely to the open position. Such arrangement provides added security against accidental or unauthorised release of the cover panel especially by a child who may release one latch but be unable to release the other and is therefore unable to open the cover panel.

One of the latches may be key operated with the other latch being operable by movement of the cover panel relative to the frame. For example where the cover panel is hinged to the frame there may be a first key operated latch comprising a first detent mounted upon one of the panel and frame for engaging with the other of the panel and frame, the first detent being releasable by key operated means, and a second latch including a second detent mounted upon one of the panel and frame for engaging with the other of the panel and frame, engagement and disengagement of the second detent being by relative movement of the panel and frame in a direction substantially parallel to the hinge axis, the panel being biased towards an open position and in a direction substantially parallel to the hinge axis relative to the frame.

Preferably, blocking means can be provided to prevent relative movement of the panel and frame in a direction substantially parallel to the hinge axis when the first latch is in its latched condition. In this way, the cover panel cannot be moved to release the second latch when the first latch is engaged. With this arrangement, the cover panel may open slightly on release of the first latch under the resilient biasing to clear the blocking means and allow relative movement of the cover panel parallel to the hinge axis to release the second latch and allow the cover panel to swing freely about the hinge axis to the open position.

The second latch may comprise one or more latching points spaced around the perimeter of the frame to prevent the cover panel being lifted (prised) away from the frame in the closed position.

The latching arrangements above-described have application to sockets with an integral (built-in) cover according to the present invention and to detachable covers of the type that can be fitted to an existing socket (or switch) to provide the socket with protection against unauthorised use. Such detachable cover may be of the type described in our earlier UK Patent No. 2366457.

Thus according to another aspect of the present invention there is provided a latching/locking system for a panel movable relative to a frame between first and second positions, the system comprising at least two latches for latching the panel to the frame in the first position, wherein engagement and disengagement of the first latch is in a direction different to that of the second latch.

The panel may be a cover panel movable between open and closed positions and the latches are operable to secure the cover panel in the closed position. This arrangement is preferred but not essential and the invention may have application to other arrangements.

The frame may be an integral (built-in) part of a socket (or switch) and the panel movable between the open position allowing access a faceplate of the socket (or switch) and the closed position shrouding a front surface of the faceplate to prevent access to the plug-pin receiving apertures (and a plug when received in such apertures) of the socket (or a switch).

Alternatively, the frame may be separate from the socket (or switch) and secured by locating a part of the frame behind a faceplate of the socket (or switch) so that the frame is held in place when the faceplate is secured to a mounting box, for example a wall mounted box or a freestanding mounting box and the panel is movable between an open position allowing access the faceplate of the socket (or switch) and a closed position shrouding a front surface of the faceplate to prevent access to the plug-pin receiving apertures (and a plug when received in such apertures) of the socket (or a switch).

The panel may be mounted for hinging or sliding movement between the open and closed positions. Preferably the latches are self-latching on so that the cover panel is secured automatically on being moved to the closed position without any additional means such as key being required. This simplifies operation for the user.

In some embodiments, the panel is mounted for hinging movement about a hinge axis between open and closed positions and disengagement of the first latch allows relative transverse motion of the panel and frame, which then disengages the second latch. Thus no further latching mechanism is required.

With this arrangement, the first latch may comprise a first detent mounted upon one of the panel and frame for engaging with the other of the panel and frame, the first detent being releasable by key operated means, and the second latch may include a second detent mounted upon one of the panel and frame for engaging with the other of the panel and frame, engagement and disengagement of the second detent being by relative movement of the panel and frame in a direction substantially parallel to the hinge axis.

The panel is preferably biased towards the open position and in a direction substantially parallel to the hinge axis relative to the frame to maintain engagement of the second latch in the closed position. In this way, the panel has to be moved parallel to the hinge axis on release of the first latch to overcome the biasing to release the second latch and allow the panel to move to the open position.

Some embodiments include blocking means to prevent relative movement of the panel and frame in a direction substantially parallel to the hinge axis to release the second latch when the first latch is in its latched condition. In this way, the cover panel cannot be moved to release the second latch when the first latch is engaged.

With this arrangement, the cover panel may open slightly on release of the first latch under the resilient biasing to clear the blocking means and allow relative movement of the cover panel parallel to the hinge axis to release the second latch and allow the cover panel to swing freely about the hinge axis to the open position.

The first latch may comprise a resilient detent in the form of a hooked clasp which engages in a notch or bore. Alternatively the clasp or detent may engage in a notch or bore in a resilient projecting member. The type of key required to release the first latch depends upon the form of first latch which may be in a number of different forms.

The second latch may comprise a single detent most typically mounted upon the cover panel, which may engage with a specific retaining member upon the frame or may just engage with a notch in the frame to provide a single latching point in the closed position.

More preferably, the second latch comprises a plurality of detents with corresponding retaining members located around the periphery of the cover panel to provide multiple latching points. The retaining members at these latching points are preferably moulded as part of the cover panel itself and, as the cover panel is closed, engage directly with apertures moulded at corresponding locations around the perimeter moulding of the base frame, wherein the retaining members, which have circular radius edges, slide into the individual apertures, (which also have rounded radius edges) and are securely retained once the cover panel is latched in the closed position. The retaining members, for example lugs, and apertures have no moving parts.

To release the cover panel, it is necessary to displace either the cover panel and/or the base frame along a plane of movement about and parallel to its hinged axis, sufficient to enable the retaining members to fully disengage from inside the base-frame apertures. This can be achieved in a number of different ways;

The preferred method deploys a compression spring mounted to the hinging mechanism of the cover panel. The spring performs two different functions. Firstly, the positioning, coiling and tension of the spring disposes the cover panel to sit to the left or right of the base plate if located on either of the horizontal axis of the base plate, or to sit above or below the base plate if located on either of the vertical sides of the base-plate.

Indeed, the cover panel and base-plate are held in alignment by virtue of their 'interlocking' shapes, otherwise the tension of the spring would cause the cover panel to be misaligned left or right, above or below the base-plate by a margin noticeable to the eye and sufficient to render the cover panel unfit for its designed purpose. Secondly, the spring causes the cover panel to open unassisted, away from the base plate once both latches are released.

The retaining members around the perimeter can be conveniently positioned so that, under tension from the compression hinge spring, the cover panel aligns suitably with the shape of the base-plate, such that any natural flex of the material is countered by the tight fit of the retaining members in their apertures around the perimeter, and thus opportunities to access the cover by the use of force are minimised. In this way, the assembly can provide a secure enclosure for sockets, plugs and the like.

Where provided, in any of the latching arrangements previously discussed, the biasing of the spring can also perform the function of assisting to maintain engagement of the latches in their latched condition. For example, the or each latch may comprise latch members provided with formations that engage and interlock under the spring biasing in the latched condition so as to resist separation of the formations until the latch is released. The latch members may comprise a latch part and a retainer part.

In order to release the cover panel, two distinct operation are required. More specifically, the release process requires both upward and lateral movement of the cover panel in order to fully release the cover panel and allow movement of the cover panel to the open position. One latch comprises the initial lock (and when unlocked, is referred to as the 'initial release'). Another latch provides a secondary lock (and when unlocked is referred to as the 'final release').

The lateral movement of the cover panel may be achieved in part by means of a formation such as a leg extending from (and permanently attached to) the underside of the cover and positioned so that, when the cover panel is closed, the formation extends into an area within the movement range of a key for releasing the first latch once the key is inserted so that operation of the key to release the first latch (initial release) may also release the second latch (final release). For example, the key may have formations that, on rotation of the key, release the first latch and then release the second latch.

Lateral movement of the cover panel may be blocked whilst the cover panel is secured in the closed position to prevent release of second latch. This may be achieved by an abutment such as a small step or web on the same side (and as close as possible to) the latching means.

With the cover panel closed, a small gap is provided between the inside surface of the cover panel and the vertical side wall of the frame or face plate. The width of the gap may be determined by the amount of lateral movement required to release the second latch and allow the cover panel to open. In the embodiments described hereinafter there may be gaps of between 2-3 mm. The abutment is sized to extend sideways by a distance slightly less than the lateral movement intended to effect the final release, but in all cases, such that it is almost flush against the inside surface of the cover panel.

The abutment also extends upwards along the vertical surface of the base plate to a height slightly less than the distance to which the torsion spring raises the cover panel away from the base plate once the 'initial release' mechanism is activated. The initial release mechanism therefore provides the means for the edge of the cover panel to clear the abutment, allowing the cover panel to move laterally once force (by means of a key against the leg or effort applied directly) is applied against the directional tension of the compression spring with sufficient movement to effect the final release.

In a modification, the abutment may include a guide face to assist relative lateral movement of the cover panel and base plate to engage the second latch in the latched condition.

Where the cover is a separate unit that can be mounted to the socket by securing the frame behind the socket faceplate, the frame may be arranged so that is can be located in position by partially releasing the screws securing the faceplate to allow the faceplate to be pulled away from the surface to which it is attached a distance sufficient for the frame to be slid into place. In this way, the socket does not have to be completely removed and/or the electrical connections to the socket disconnected to fit the cover.

For UK sockets (and switches), the faceplate is traditionally of rectangular shape and the frame may be of U-shape that can be slid into place from above to extend on three sides of the faceplate leaving an opening in the other side for passage of the lead of a plug(s) when the cover is secured in position and the plug(s) is shrouded by the cover panel in the closed position. Typically, the frame extends across the top and down both sides of the faceplate leaving the opening at the bottom.

With this arrangement, pulling forces applied to the cable may be transferred to the latch(es) via the cover panel and this could result in the cover panel being forced open.

Some embodiments of the invention may therefore provide a frame that extends on all four sides of the faceplate with the opening being arranged so that pulling forces applied to a cable passing through the opening is transferred to the frame which is securely mounted and can better withstand the forces. In this way, the pulling forces are not applied to the latches.

The transfer of forces to the frame may be achieved by means of a detachable cable tie that can be fitted after locating the cable in the opening. In this way the plug does not have to be removed from the cable in order to feed the cable through the opening. The cable tie may also help to prevent the plug being disconnected by pulling the cable while the cover panel is in the closed position.

In order that the frame can be fitted to extend on four sides of the faceplate without completely removing the faceplate and disconnecting the electrical connections, the frame preferably comprises at least two frame members that can be arranged to extend around the faceplate and located behind the faceplate so as to be secured by the faceplate.

In one arrangement, the frame members comprise a U-shaped frame member as described above that can be slid into place to extend across the top and down both sides of the faceplate and a base frame member that can be positioned to extend across the bottom of the faceplate and attached at each end to the U-shaped frame member. For example, the base frame member may be provided with formations at each end that engage mating formations of the U-shaped frame member on both sides of the faceplate.

Preferably, the frame members are arranged so that the engaged portions can be located behind the faceplate so as to inhibit disconnection when the cover is secured in position. The base frame member may be provided with at least one opening for passage of cable lead(s) and at least one tie member so that pulling forces applied to the cable are transferred to the frame and away from the cover member.

Thus, according to yet another aspect of the present invention, there is provided a detachable cover for a socket (or switch) comprising a frame arranged to extend around the perimeter of a faceplate of the socket or switch and a cover panel connected to the frame for movement between open and closed positions, the frame comprising at least two frame members capable of being arranged to extend around the faceplate and secured in place.

Features of the invention described herein may also be applied to arrangements in which the cover panel is sidable between the open and closed positions.

Thus, according to another aspect of the present invention, there is provided a cover for a faceplate of a socket, switch or the like comprising a cover panel slidable between open and closed positions.

The cover may be a separate, detachable unit that is located behind the faceplate or it may be an integral (built-in) part of the faceplate.

The invention may also extend to include the integral (built-in) covers and separate, detachable covers described herein having a cover panel mounted for movement between open and closed positions and latch means for securing the cover panel in the closed position, where the latch means comprises a single latch or a multiple latch.

Single latches may be released by axial and/or rotational movement of an actuator such as a key. Where provided, multiple latches may be released simultaneously or in sequence. Sequential release of multiple latches may be effected in a variety of ways. For example by axial and/or rotational movement of an actuator such as a key. Thus, axial insertion of a key may release a first latch with rotational movement of the key releasing a second latch or vice versa. Alternatively, two or more latches may be released in sequence at different axial or rotational positions of the key. Other combinations of latches and actuators will be apparent to those skilled in the art.

Embodiments of the invention may also incorporate one or more additional features to add functionality.

Thus, according to a still further aspect of the present invention, there is provided a cover for a faceplate of a socket, switch or the like, the cover having a cover panel moveable between an open position and a closed position by hinging or sliding movement and being secured in the closed position by latch means, wherein the faceplate includes one or more additional features such as a light source, air freshener, and a fuse holder.

The cover may be a separate, detachable unit that is located behind the faceplate or it may be an integral (built-in) part of the faceplate.

The light source may be activated by a push button, for example the light source may comprise a night light. Alternatively or additionally, the light source may be activated when the cover panel is opened. The air freshener may be heat activated, for example by heat emitted by the light source.

According to another aspect of the present invention, there is provided a cover for a faceplate of a socket, switch or the like, latch means operable to secure a cover panel in a closed position, actuator means for releasing the latch means, and biasing means for urging the cover to an open position.

The cover may be a separate, detachable unit that is located behind the faceplate or it may be an integral (built-in) part of the faceplate.

According to another aspect of the present invention, there is provided a faceplate for a socket, switch or the like having an integral (built-in) cover with a cover panel movable between an open position and a closed position.

The faceplate may be secured to a wall mounting box or to a freestanding mounting box.

According to another aspect of the present invention, there is provided a fitting comprising a base part having a socket or switch and a cover panel mounted on the base part for movement between a closed position concealing the socket or switch and an open position allowing access to the socket or switch.

The fitting may comprise a faceplate for a socket or switch that can be secured to a wall mounting box or to a freestanding mounting box.

DESCRIPTION OF THE DRAWINGS

Embodiments of the invention in its various aspects will now described in more detail by way of illustration only, with reference to the accompanying diagrammatic drawings in which:

FIGS. 1, 2 and 3 show views of a conventional electric plug, socket box and plate mounted in a wall;

DETAILED DESCRIPTION

Figure 4:
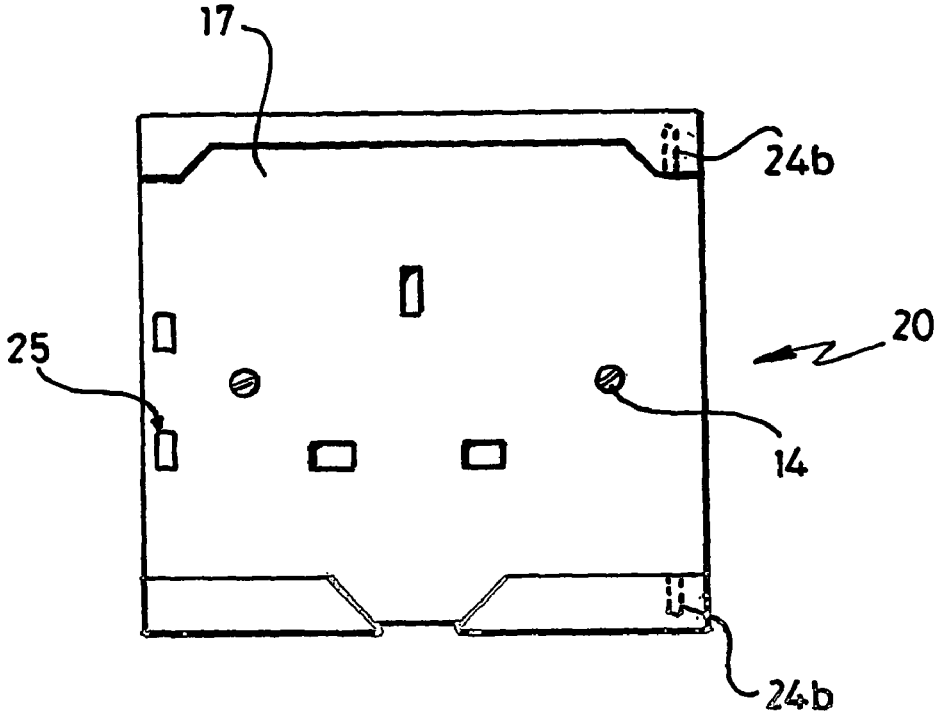
FIGS. 4 and 5 show front and perspective views of the faceplate of a single socket with integral (built-in) cover of the invention but with the cover panel removed.

Referring first to FIGS. 1 to 3, a conventional plug/socket combination is shown (to avoid confusing complexity, the Figures do not show any of the wires leading to the socket, nor do they show the details of the internal structure of the terminals). Mounted in a hole in the wall (11) is a metal socket box (12) with an inwardly directed front flange (13) onto which a socket plate (17) is affixed by screw-headed bolts (14) engaging with threaded holes (15). The socket plate (17) contains the usual plug pin holes (18)—earth/ground, live, neutral—into which the pins of the plug (19) fit.

Figure 5:
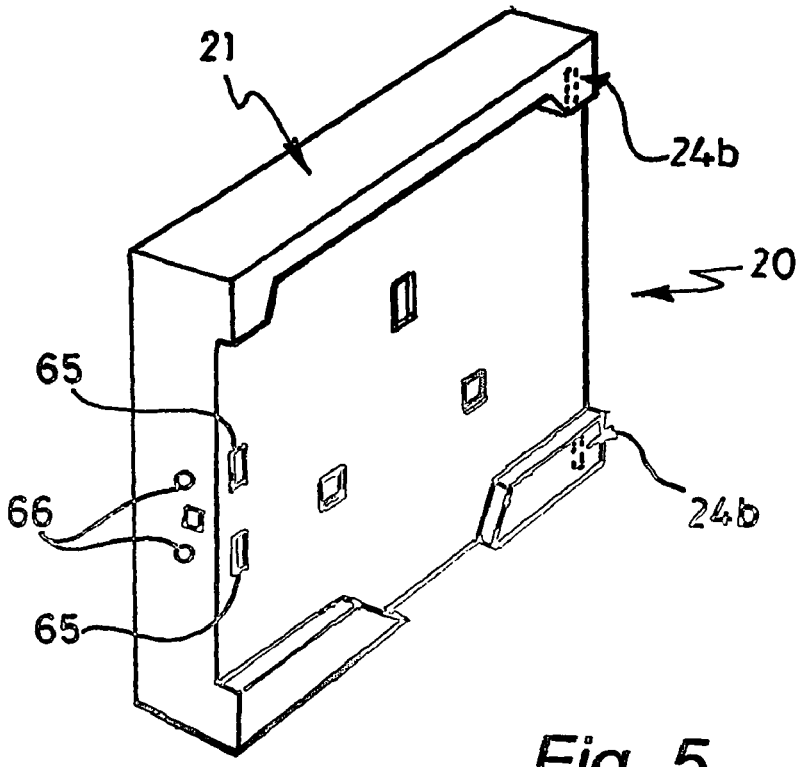
Figure 6:
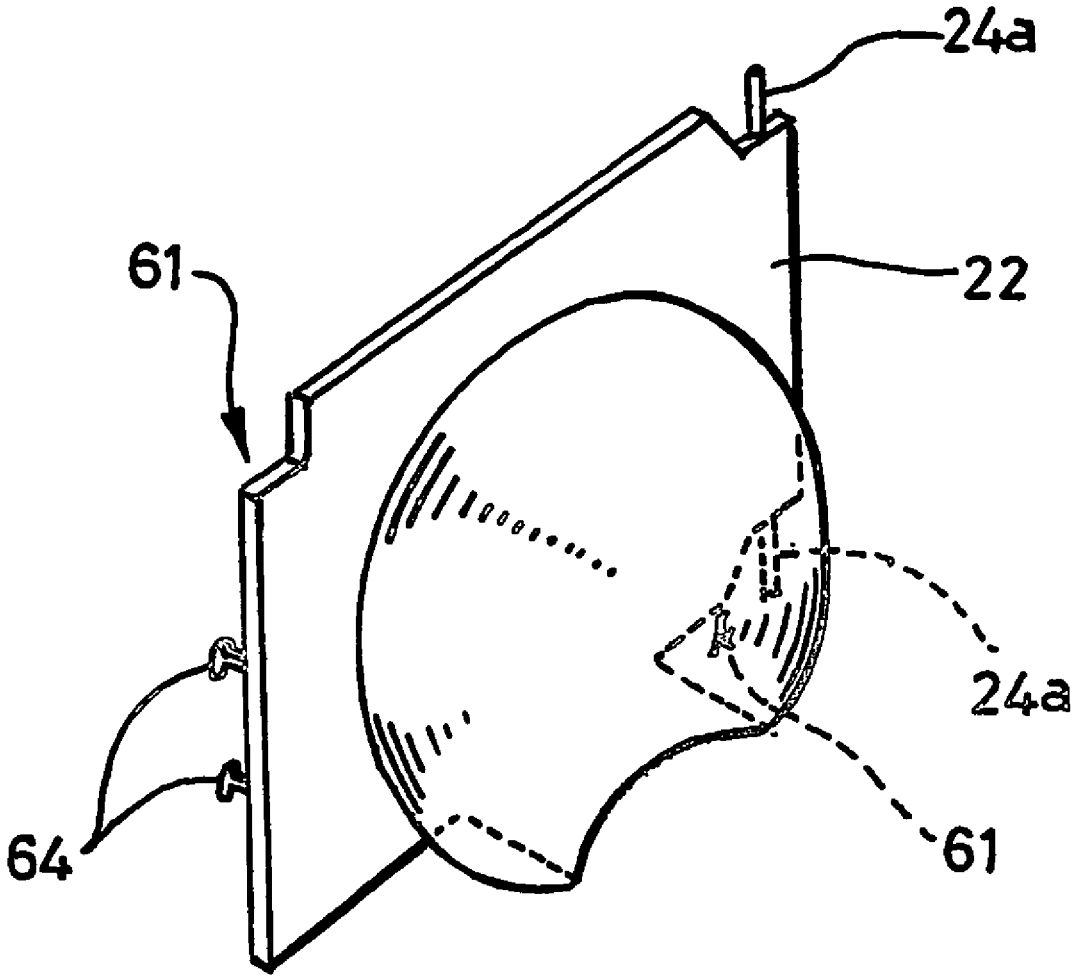
FIG. 6 shows a perspective view of the cover panel of the socket shown in FIGS. 4 and 5 separate from the frame.

With reference now to FIGS. 4 to 6, a first embodiment of a socket with integral (built-in) cover of the invention is shown comprising the combination of a socket faceplate (20) with integral frame (21) and a lockable cover panel (22). The faceplate (21) is mountable on a wall (not shown) by way of the screw headed bolts (14) for securing the face plate (20) to a mounting box (not shown) either recessed in the wall or surface mounted.

The frame (21) is arranged at the perimeter of the faceplate (20) and extends across the top and bottom. The cover panel (22) is hingedly secured to the frame (21) by a hinge pin/socket arrangement (24*a*,24*b*) for hinging movement about a vertical axis at one side of the faceplate (20) (the tight as viewed in the drawing). The panel (22) is swingable between a closed position, where it completely covers and encloses the front surface of the faceplate (17) and any plug therein, and an open position, where it is clear therefrom, allowing access thereto. The hinge mechanism is biased (in a manner not shown here) so that when the panel (22) is released it will spring open by itself.

In the embodiment shown, the frame (21) is formed integrally with the face plate (17) for example by moulding and the socket is quite bulky. On the side distant from the hinge pin/socket (24*a*,24*b*), the faceplate (17) contains internal latch means for holding the cover panel (22) closed. As can seen, the panel (21) has projecting latch pins (64) that pass into the faceplate (17) via corresponding latch holes (65) to engage with the latch means until released by a key (not shown) inserted into two keyholes (66) in the side of the frame (21) to allow the panel (22) to move to the open position under its spring biasing. The latch means is self-latching to secure automatically the cover panel (22) on being moved from the open position to the closed position.

As will be clear from FIGS. 4 to 6, the frame (21) and the cover panel (22) are shaped, especially at the corners (61), to fit one to the other so as to form a flush front surface that has no protruding edges for a child's finger nails to get under in an attempt to prise the two apart.

Figure 7A:
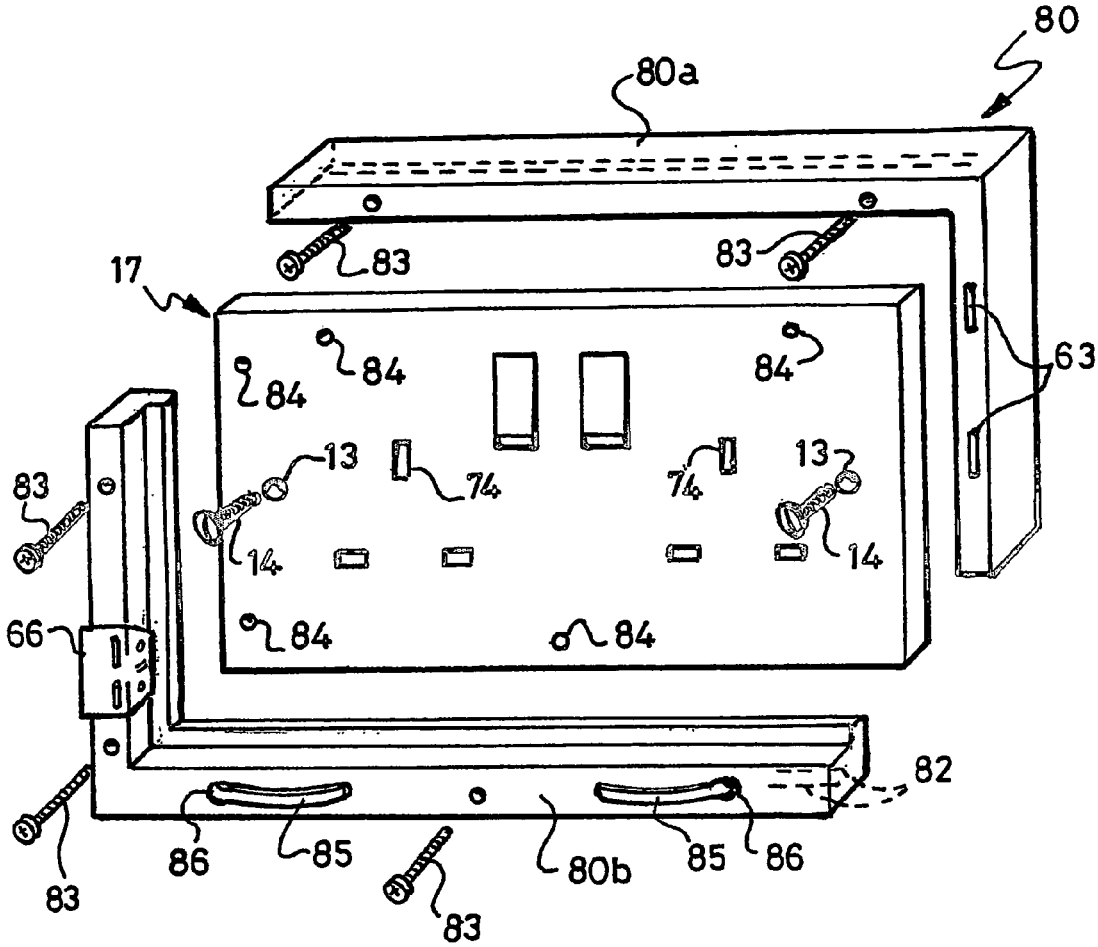
FIGS. 7*a* & 7*b* show views of an interlocking frame for a double socket with integral (built-in) cover of the invention.
Figure 7B:
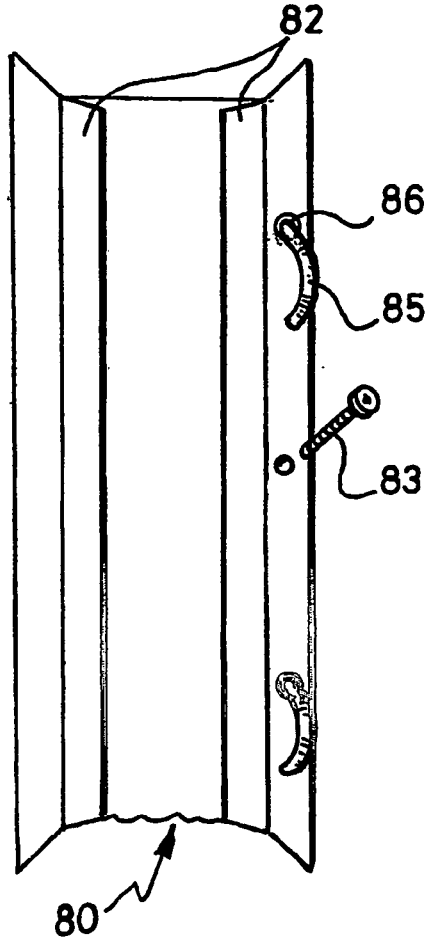

FIGS. 7*a* and 7*b* show an interlocking frame (80) for a faceplate (17) of a double socket that is secured to a wall mounting box (not shown) by screws (14) that extend through holes (13) in the faceplate (17).

The perimeter of the socket faceplate (17) is enclosed within the frame (80). The inner perimeter of the frame (80) has within it two parallel lips (82) of flexible material such as plastic or rubber arranged at an angle perpendicular to the front surface of the frame (80) and running along the entire perimeter of the inside of the frame (80). These lips (82) grip the faceplate (17) as it is retained between the lips (82) as a snug fit.

The frame (80) is assembled first by the interlocking of the frame parts 80*a*,80*b* and lips (82) around the faceplate (17), and then by the application of flat-ended screw bolts (83) that extend through the outer edge of the frame (80) and into holes (84) in the surface of faceplate (17). The screw bolts (83) are of a non-removable, tamper-proof type such that the frame (80) is permanently secured to faceplate (17). In this way, the frame (80) is integral (built-in) to the faceplate (17).

Cable ties (85) are attached by being threaded from the inside of the frame part (80*b*) through apertures (86) from the underside of the hollow frame part (80*b*) prior to the frame being slid into place around the faceplate (17). The cable ties (85) are arranged to receive the leads of plugs (not shown) inserted in the sets of pin receiving holes (74) so that pulling forces applied to the leads are transferred to the frame (80). Alternatively, the cable ties (85) can be moulded as a permanent part of the perimeter frame (80).

Hinges (63) for the cover panel are provided on one side edge and latch means (66) is provided on the opposite side edge for securing the panel in the closed position. In this way, the cover panel (not shown) opens with a hinging motion from left to right on the side hinges (63). The latch means (66) may be of any type described herein to secure the cover panel in the closed position.

Figure 8:
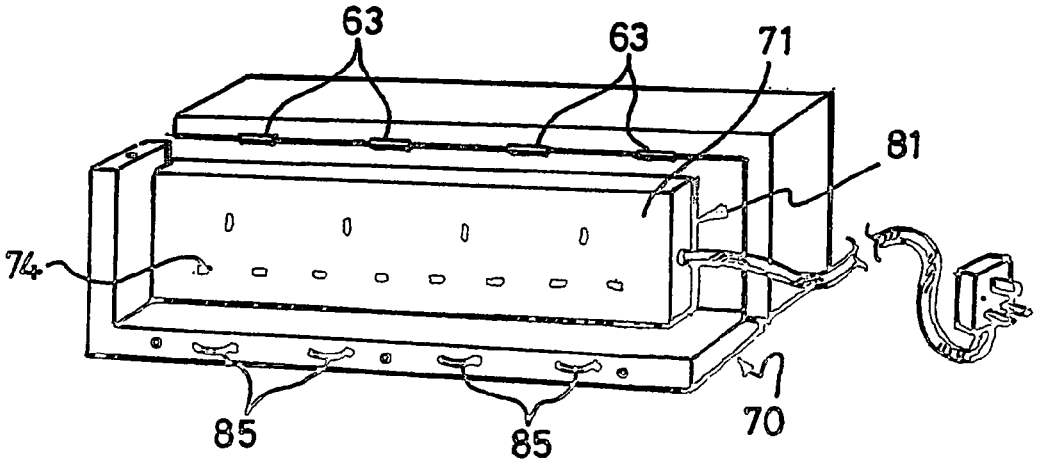
FIG. 8 shows a view of an interlocking frame for a freestanding multi-outlet socket with integral (built-in) cover of the invention.

FIG. 8 shows an interlocking frame (70) for a freestanding multipoint extension socket or strip adaptor (81). The frame (70) is assembled around a base (71) of the multipoint socket (81) and secured in similar manner to the frame (80) described above to become an integral (built-in) part of the frame (80).

The frame (70) has cable ties (85) that are threaded through holes in the bottom edge of the frame (70) and receive the leads of plugs (not shown) inserted in the sets of pin receiving holes (74) so that pulling forces applied to the leads are transferred to the frame (70).

A cover panel (not shown) is connected to the frame (70) by hinges (63) along the top edge of the frame (70) and is secured in the closed position by latch means (not shown) at the bottom edge of the frame (70). In this way, the panel lifts away from the plugs on being opened. The latch means may be of any type described herein to secure the cover panel in the closed position.

Figure 9:
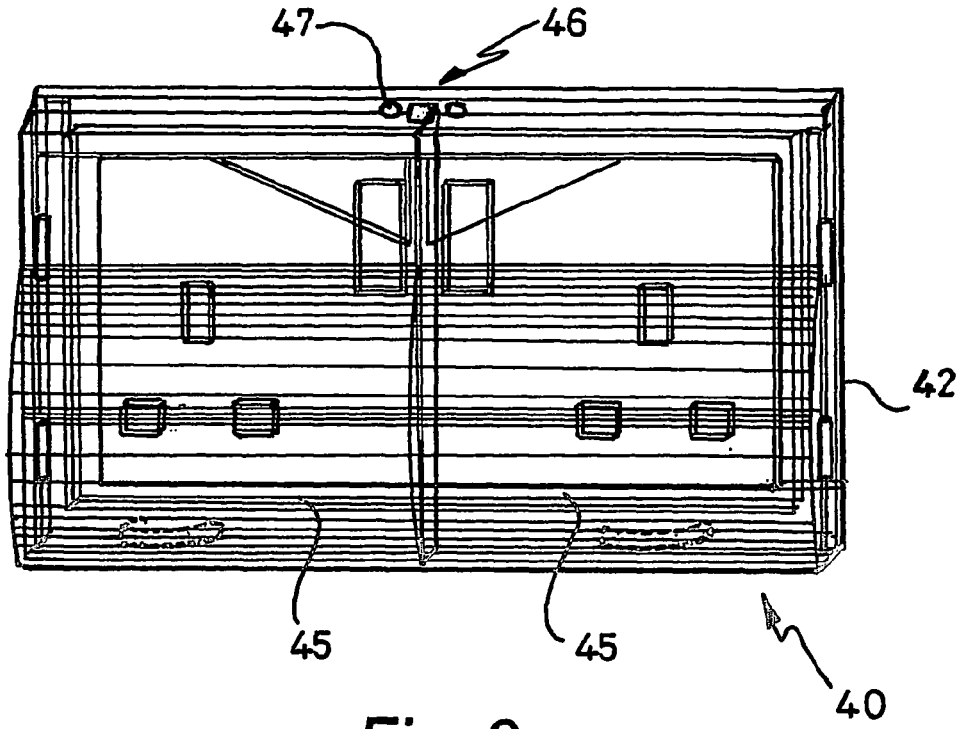
FIG. 9 shows a front view of a double socket with integral (built-in) cover of the invention having side hinged cover panels shown in the closed position.
Figure 10:
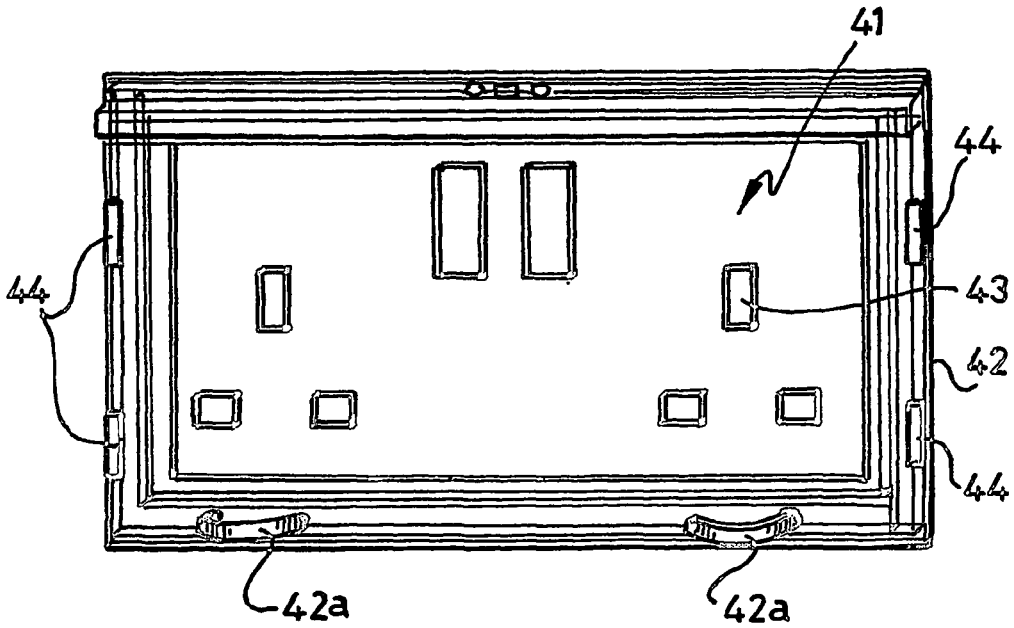
FIG. 10 shows a front view of the socket of FIG. 9 with the cover panels removed.
Figure 11:
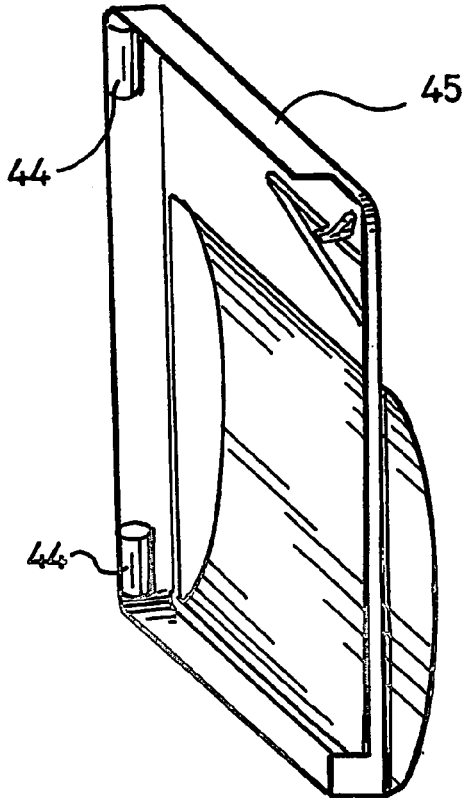
FIG. 11 shows a rear perspective view, to an enlarged scale, of one of the cover panels shown in FIG. 9.

FIGS. 9 to 11 show another embodiment of a double socket (41) with integral (built-in) cover (40). The cover (40) has a frame (42) that is formed integrally with or permanently secured around the periphery of the socket (41) as described previously and has cable ties (42*a*) for the cable leads of plugs (not shown) inserted in the pin receiving holes (43) of the socket (41).

The frame (42) has hinges (44) on both vertical side edges that mount a pair of cover panels (45) for hinging movement between a closed position shown in FIG. 9 in which the panels (45) meet at the centre of the socket (41) and an open position (not shown) in which the panels (45) move outwards with a hinging motion from the centre to the opposed side edges.

The panels (45) are secured in the closed position by a latch mechanism (46) positioned centrally of the top edge of the frame (42) and operable by a key (not shown) inserted through holes (47) in the upper surface of the frame (42). The panels (45) are provided with arcuate sections that provide clearance to accommodate a plug inserted in the socket when the panels (45) are closed. The panels (45) may be secured by a common latch mechanism (46) to be released simultaneously when the key is inserted. Alternatively, each panel (45) may be secured by a separate latch mechanism allowing the panels to be opened/closed individually.

Figure 12A:
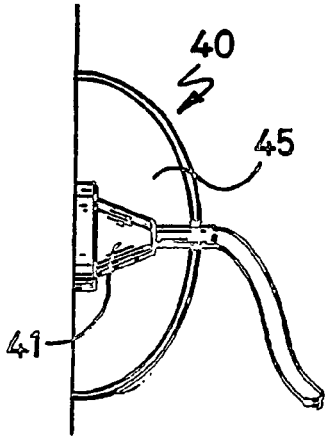
FIGS. 12*a* & 12*b* show a modified version of a single socket with integral (built-in) cover of the invention having side hinged cover panels for use with plugs that are centrally mounted.
Figure 12B:
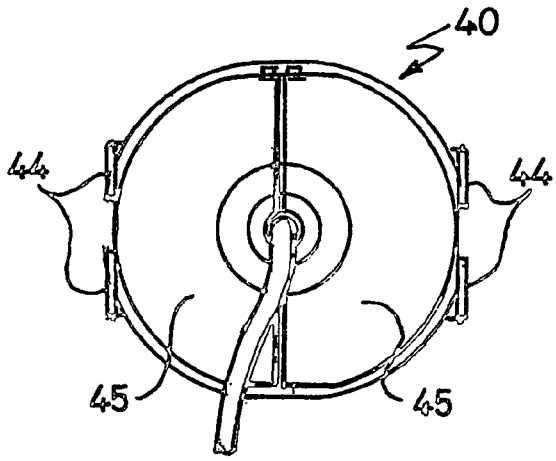

FIGS. 12*a* and 12*b* show a modification to the cover (40) suitable for use with plug and socket systems in which the cable extends from the centre of the socket, rather than at the bottom. Such systems are commonly in use throughout America and Europe. For convenience like reference numerals are used to indicate parts corresponding to FIGS. 9 to 11.

Figure 13A:
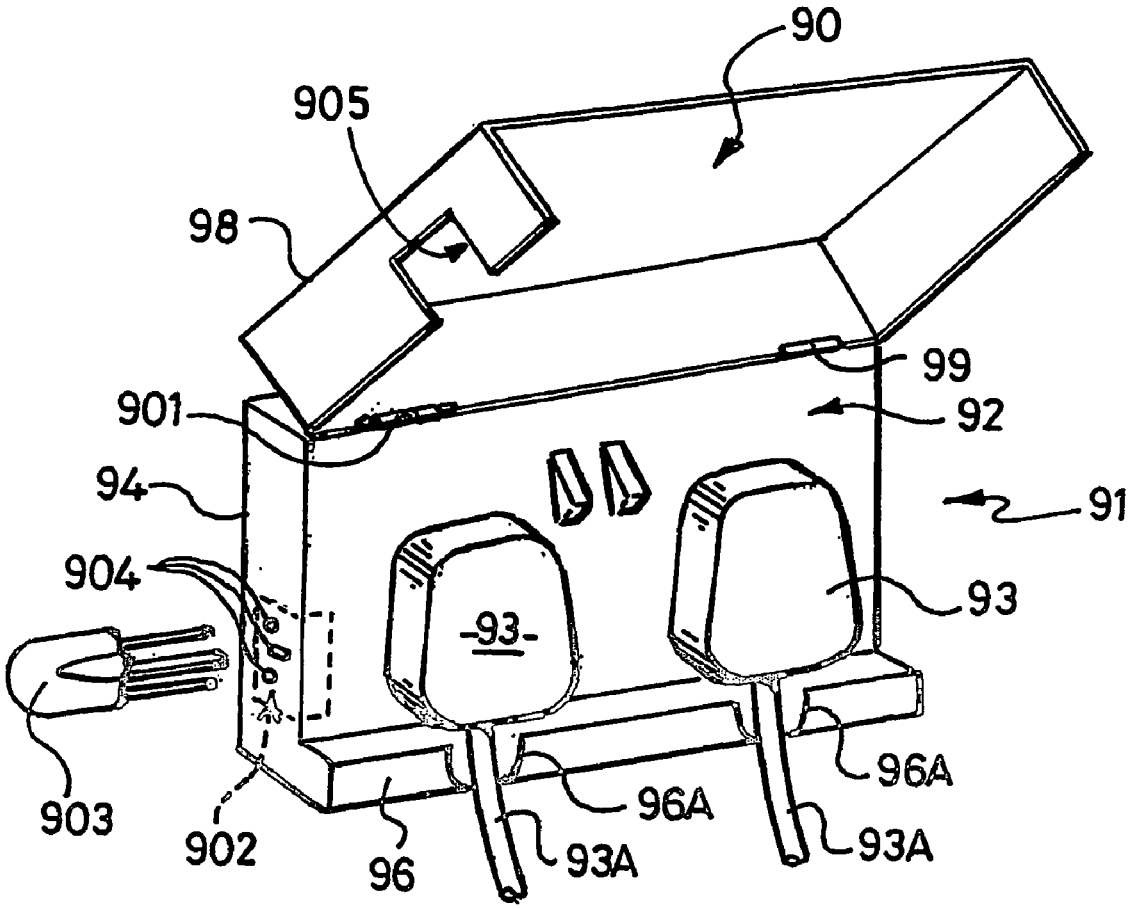
FIGS. 13*a* & 13*b* show details of a double socket cover with integral (built-in) cover of the invention with a top hinged cover panel shown in the open position and a key operated locking mechanism having a three pronged key.
Figure 13B:
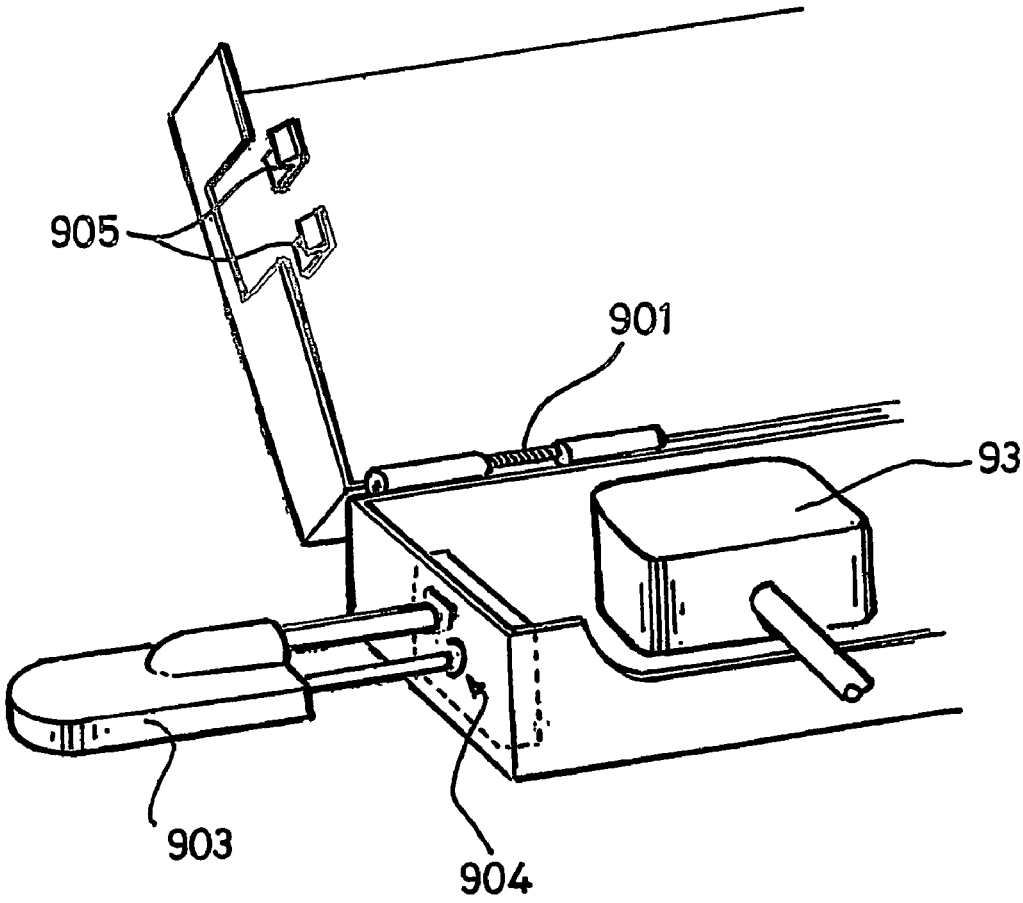

FIGS. 13*a* and 13*b* show details of another embodiment of a double socket (91) with integral (built-in) cover (90) of the invention. The double socket (91), which is a switched socket, has a socket plate (92) having two sets of socket holes (not visible) in each of which is received a standard plug (93) with its attached cable (93A). The socket plate (92) is attached (by screw-headed bolts, not shown) to a mounting box (not visible) mounted in a recess in the wall (not shown).

Surrounding the socket plate (92) is the frame (94) for the cover (90). The frame (94) is formed integrally with or is permanently secured to the socket plate (92) as described previously. The frame (94) has an upstanding perimeter wall (96) that is apertured at (96A) to allow the plug cables (93A) to pass through. The cover (90) has a cover panel (98) hinged by a pin/socket mechanism (99) to the frame (94) along the upper (as viewed) edge of the socket plate 92. The cover panel (98) is biased by a spring (901) towards the open position.

A lock mechanism (902) is mounted internally of the frame (94) on the left (as viewed) hand side of the perimeter wall of the frame (94) into which a three-pronged key (903) can be inserted via suitably-shaped apertures (904) in the perimeter wall of the frame (94).

Figure 14A:
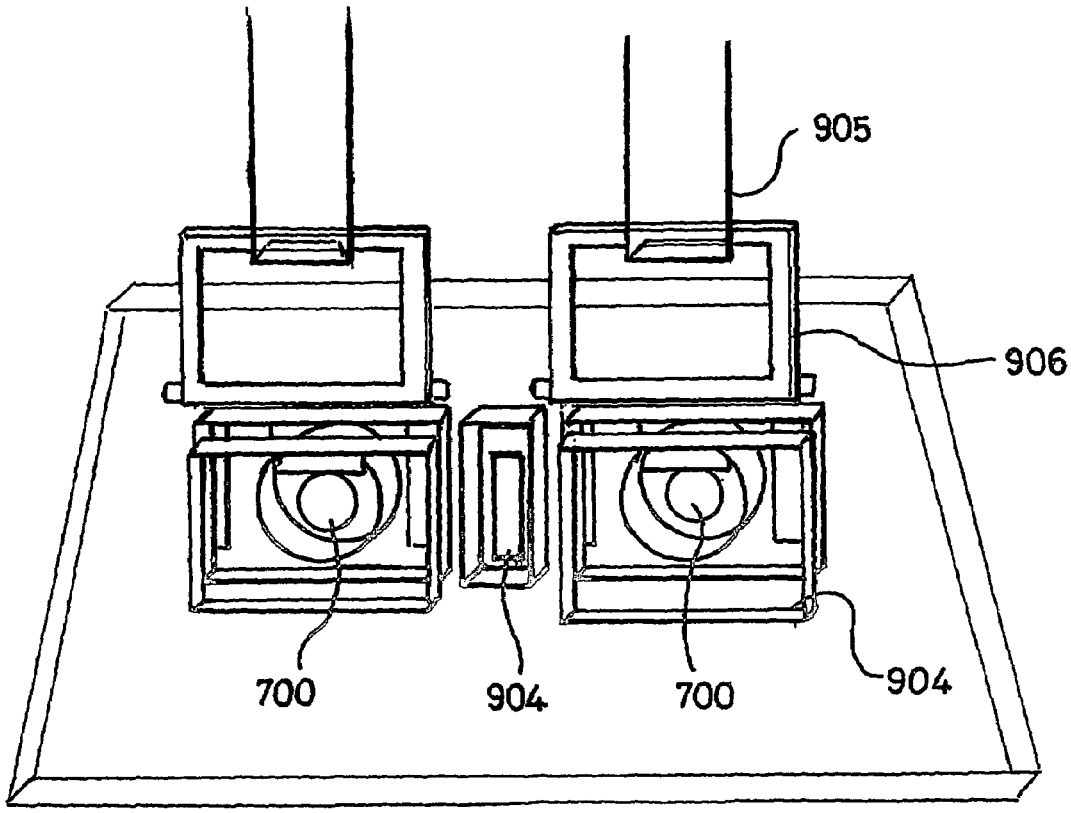
FIGS. 14*a* & 14*b* show details of the locking mechanism.
Figure 14B:
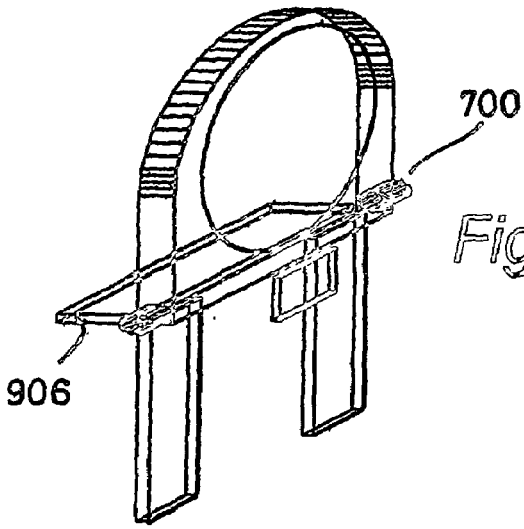

With reference now also to FIGS. 14*a* and 14*b*, the cover panel (98) is provided with two pin detents (905) that project from the inner surface of the cover panel (98) and engage with retaining apertures (700), or 'flexing eyelets' to secure the cover panel (98) in the closed position.

Figure 15A:
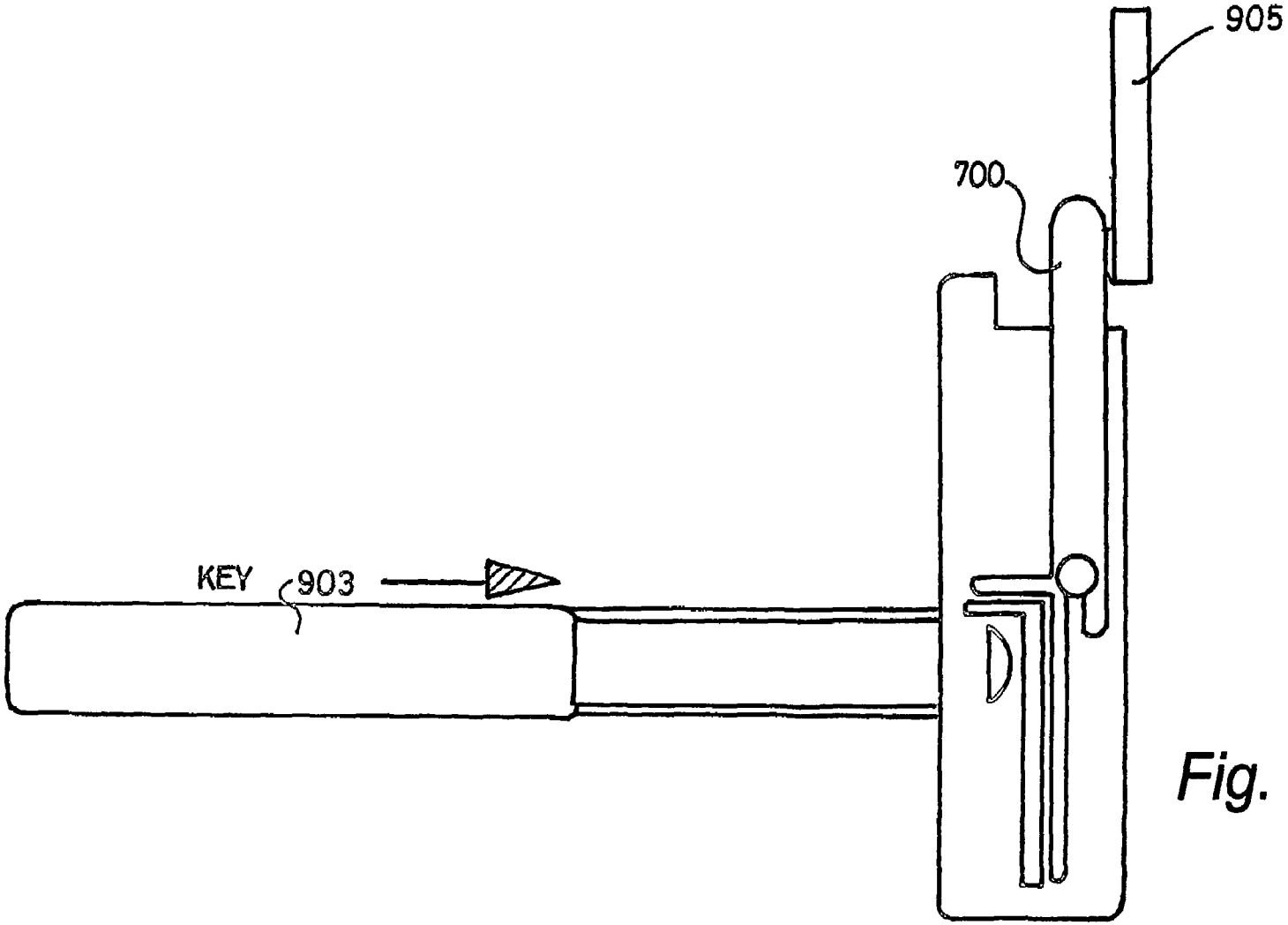
FIGS. 15*a* & 15*b* show the operation of the locking mechanism.
Figure 15B:
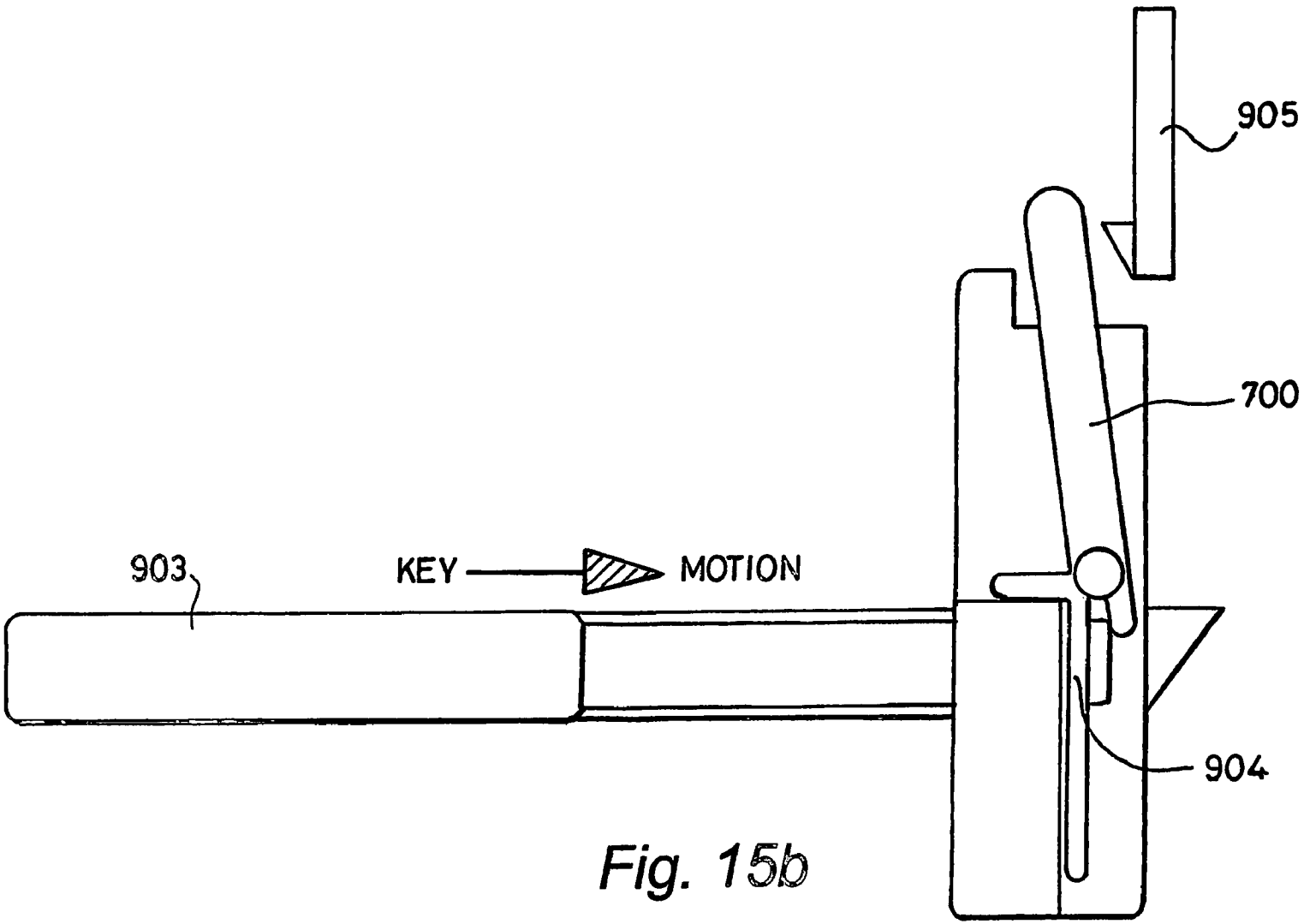
Figure 16A:
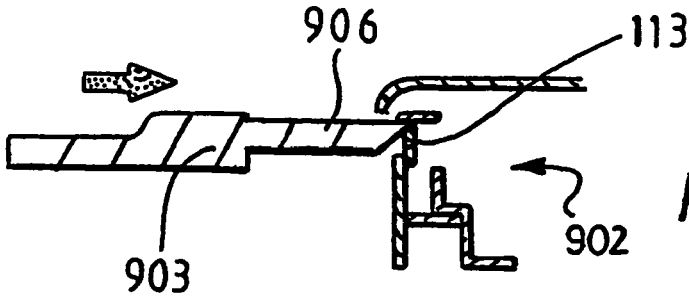
FIGS. 16*a-d* show details of an alternative locking mechanism for the cover of FIGS. 13*a* & 13*b;*
Figure 16B:
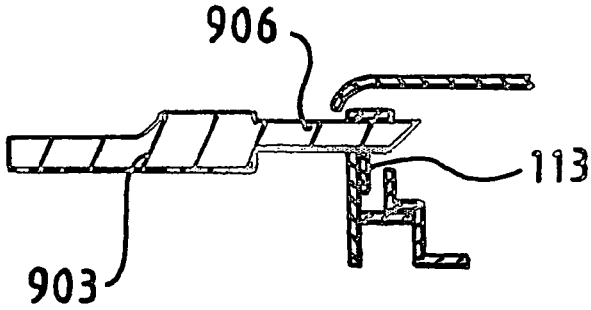
Figure 16C:
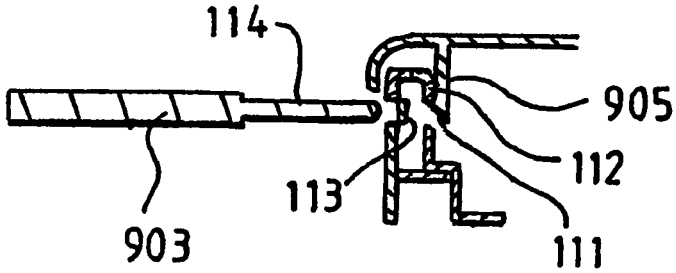
Figure 16D:
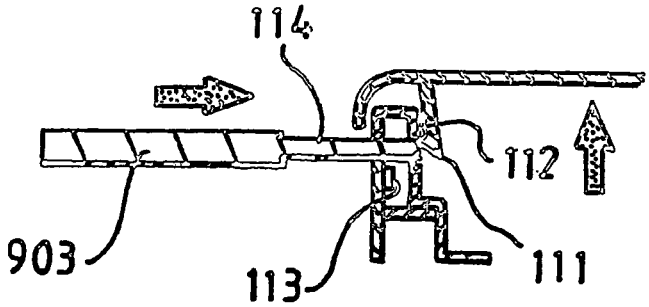

As best shown in FIGS. 15*a* and 15*b*, the eyelets (700) are mounted on retaining hinges (701) within and perpendicular to the direction of insertion of the three-pronged key (903). FIG. 15*a* shows the cover panel detents (905) engaged with the eyelets (700) rendering the cover locked. The key apertures (904) are closed in the locked condition by flaps (906). FIG. 15*b* shows the key (903) moving along the lock shaft where the centre prong opens the apertures and the outer prongs cause the body of the eyelets (700) to rotate in a counter direction sufficient to disengage the cover panel detents (905) from the eyelets (700) allowing the cover panel (98) to move to the open position under the biasing of the spring (901) to allow access to the socket switches and any plugs inserted in the socket.

With reference now to FIGS. 16*a-d*, an alternative locking mechanism (902) is shown in which like reference numerals are used to indicate corresponding parts. In this arrangement, the tips (111) of the detents (905) on the underside of the cover panel (98) hook under an inner lip (112) on the side wall of the frame (94) to retain the cover panel (98) in the closed position (see FIG. 16*c*). In this condition, a spring-loaded shutter (113) blocks the apertures (904) to prevent a tool being inserted to release the detents (905).

As the three pronged key (903) is inserted into the apertures (904) of the locking mechanism, the centre, longer prong (906) engages the shutter (113) and forces shutter (113) down against its biasing to open the apertures (904) allowing access to the mechanism per se. As the key (903) penetrates further so the two side prongs (114) move on through the now unguarded gap into contact with the tips (111) of the detents (905) and push them away from the lip (112) thus releasing the cover panel (98) and allowing the spring (901) to drive the cover panel (98) to the open position.

If the key (903) is then removed, the sliding shutter (113) slides shut, blocking off the keyhole apertures (904) and, when the panel 98 is next pushed shut, the tips (111) of the detents (905) click into place under the lip (112) and the cover panel (98) is held securely in the closed position.

Figures 17A, 17B, 17C:
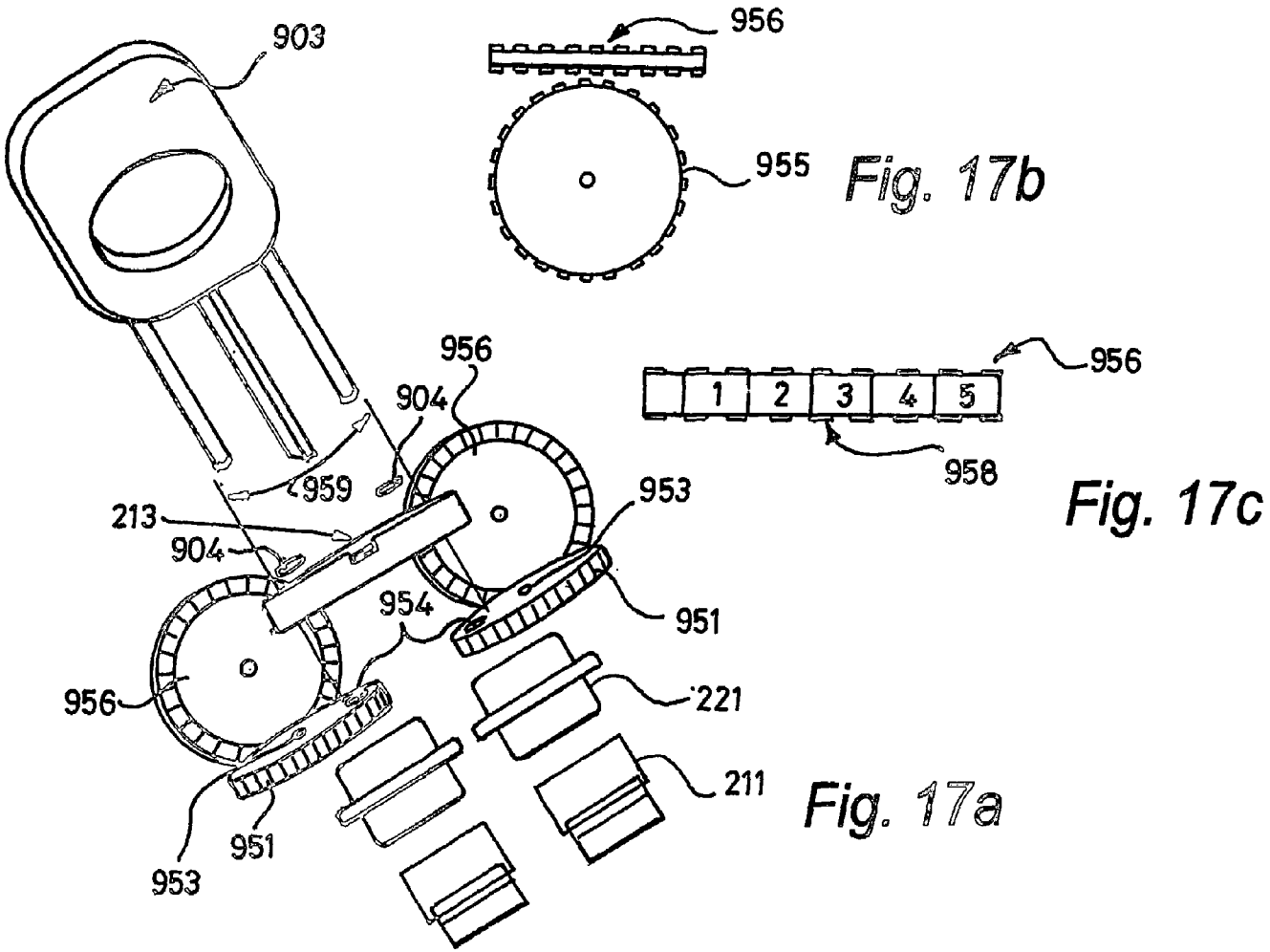
FIG. 17 shows details of an alternative locking mechanism for use in a cover like that of FIGS. 13*a* & 13*b;*

With reference now to FIGS. 17*a-c*, there is shown an alternative locking mechanism for use with the covers described herein. The locking mechanism has two circular discs (951) that are arranged in position between seared release pins (211) or T-shaped rocker cams (221) where fitted, and spring-loaded shutter (213).

The internal discs (951) have solid faces (952) save for a hole machined into the centre of each disc (953) to create a fixing point for an axle type attachment (not shown) that allows the disc to turn, and a further hole (954) machined into the face (952), the shape, positioning and size of which allows a single prong of either the 2 or 3 pin key (903) to pass through unimpeded.

Each internal disc (951) is serrated on its outer perimeter (955), so that they may engage with and be rotated by a controlling disc (956)—see FIG. 17*b*. The controlling discs (956) are serrated on their inner perimeter (957) and are numbered on their outer perimeter (958)—see FIG. 17*c*.

The outer perimeter (958) of each controlling disc (956) protrudes through the casing of the key barrel (959) at points just to the outside of each keyhole aperture (904). When the controlling discs (956) are turned on their axis the numbers on the perimeters are visible to the user.

Turning the controlling discs (956) causes the internal discs (951) to move around too. The mechanism functions such that the numbers on each controlling disc (956) can be aligned in combination to a predetermined point or marker (for example machined onto the outside of the cover) whereby the holes (954) on each internal disc (951) correspondingly and simultaneously align inside the barrel (959) with the holes (904) for inserting a two prong key or, where the shutter (213) is provided, a three prong key to displace the shutter (213) for passage of the other two prongs to make contact with the mechanism to release the cover panel (not shown) so that it may open. Unless the discs (951) are arranged correctly in combination, the passage for the key prongs to travel along the barrel (959) is blocked and the cover panel remains locked. It will be understood that the number of latches and discs may be altered as desired for use with a key having an appropriate number of prongs.

Figure 18A:
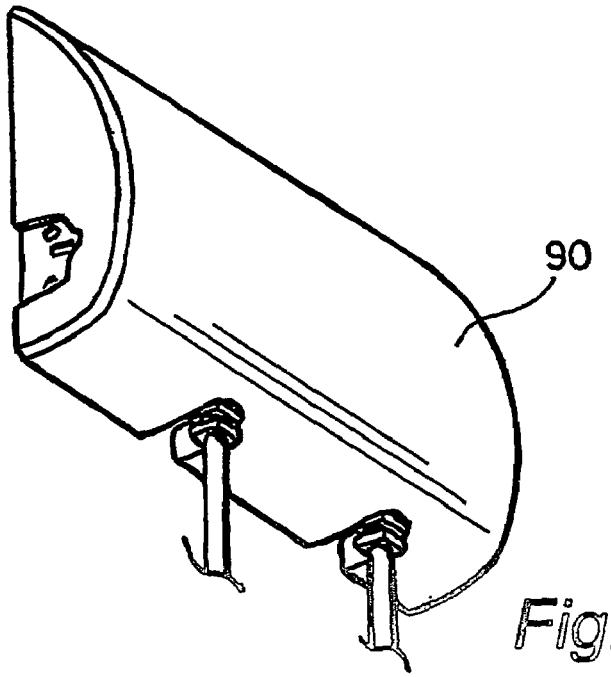
FIGS. 18*a* & 18*b* show perspective views of an alternative socket with integral (built-in) cover of the invention in the closed and open positions.
Figure 18B:
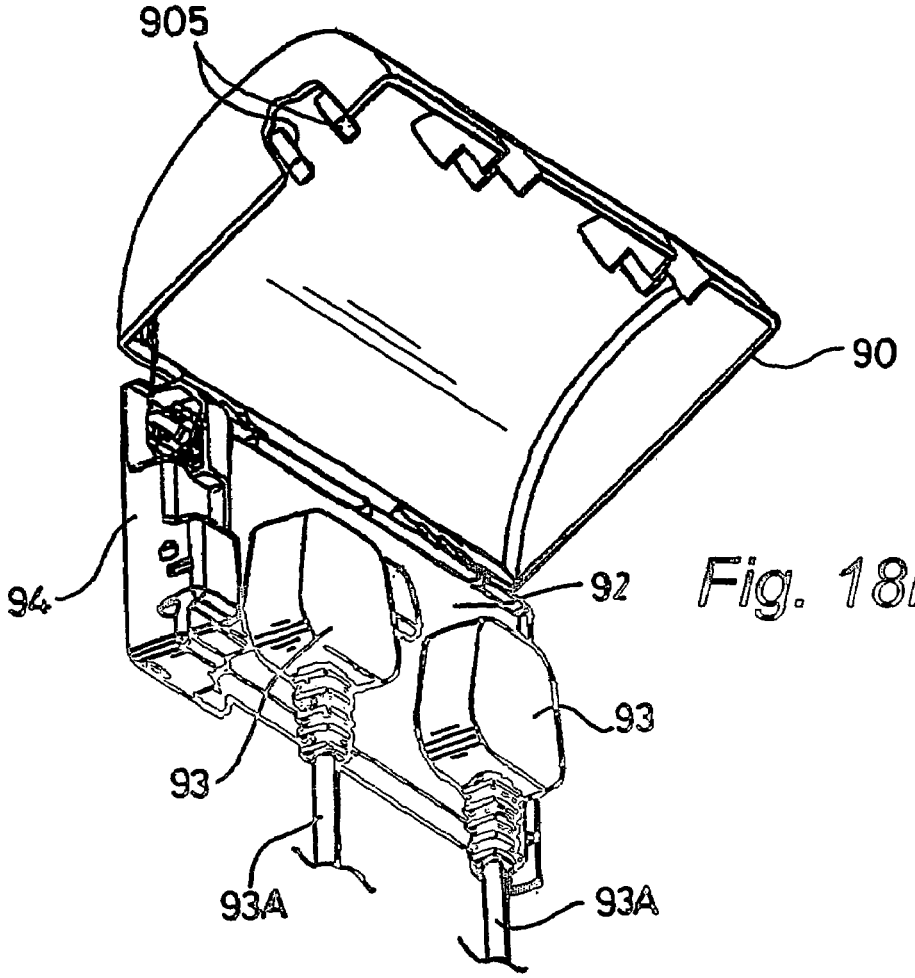

Referring now to FIGS. 18*a* & 18*b*, an alternative double socket with integral (built-in) cover is shown in both the closed and open positions. For convenience, the same reference are used to indicate parts corresponding to FIGS. 13*a* & 13*b*. Though visually somewhat different, conceptually this embodiment is similar and the operation will be understood from the description of previous embodiments.

Figure 19:
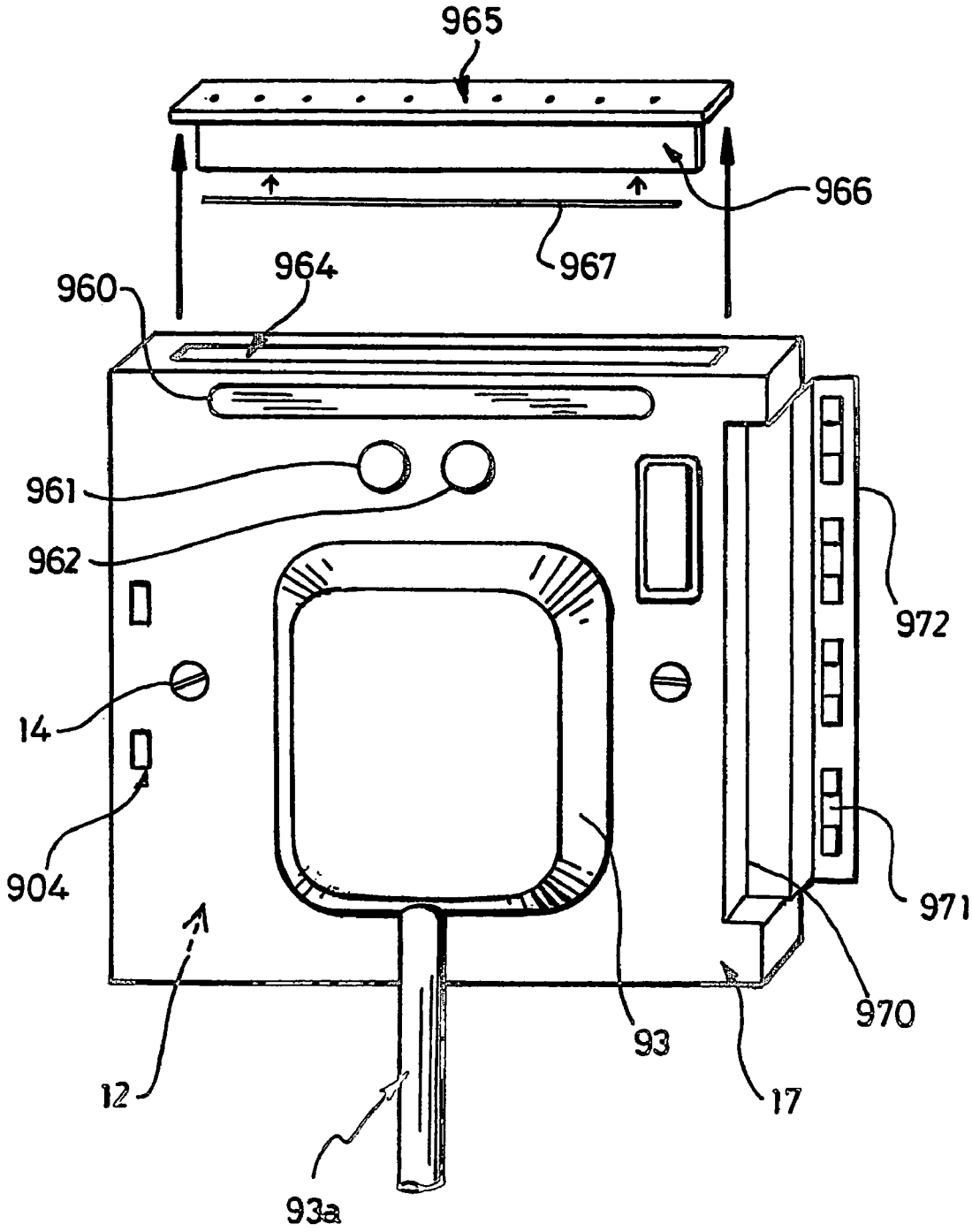
FIG. 19 shows a faceplate incorporating a night light, air freshener and fuse holder for a socket with integral (built-in) cover of the invention with the cover panel detached for clarity.

Turning now to FIG. 19, there is shown an embodiment of a single socket with integral (built-in) cover according to the present invention with the cover panel removed for clarity and incorporating features providing the socket with added functionality. Where convenient, like reference numerals are used to indicate parts already described.

The socket face plate (17) and the mounting box (not shown) to which it is attached by screws (14) incorporate additional wiring (not shown) and on/off push button switches (961,962) to facilitate the function and control of a powered bulb (960) for a night light located across and close to the top of the faceplate (17).

The light can project its beam through either a translucent cover panel (not shown) or through a slot cut into a solid (opaque) cover panel (not shown). The switches (961,962) for the night-light are located on the faceplate (17) such that they are accessible only when the safety cover panel is open.

An L-shaped heat activated scented air freshener (966) is shaped and sized to fit exactly a slot (964) located along the top edge of the cover frame surrounding the faceplate (17). The outer face (965) of the air freshener (966) is perforated with holes to allow scent from below to pass up through the holes.

The part of the air freshener (966) that drops into the slot (964) is positioned so that at least one face is located close to a suitable heat source—in this case the night-light (960)—and carries self adhesive strips of an absorbent, fire proof material (967) impregnated with scented liquid which, when subjected to a small amount of heat applied nearby, causes the liquid to evaporate and the air about it to perfume.

All but the open top of the slot (964) is sealed to be water tight from the remainder of the socket. The slot (964) may be located in front of the hinges (not shown), and thereby inside the cover panel, or behind the hinges and therefore outside of the cover panel.

As shown, a hinged door (972) is also provided along one side of the socket/faceplate frame for a hollow fuse compartment (970) and dispenser (971). The inside of the door (972) has moulded or attached retaining clips (971). Each clip (971) is designed and capable of holding one standard electric fuse in the vertical or horizontal position.

As will be understood from the description of previous embodiments, a cover panel is hinged to the faceplate for pivotal movement between open and closed positions and has detents that are received in holes (904) in the closed position to engage latch means (not shown) to secure the panel in the closed position. The latch means is released by a key and the panel is biased to the open position as already described for other embodiments.

Referring now to FIGS. 20*a-e* there is shown another locking mechanism for securing a cover panel (CP) in a closed position. The cover panel (CP) may be part of an integral (built-in) cover as already described or a separate detachable cover of the type described later herein or in our earlier UK Patent No. 2366457.

Figure 20A:
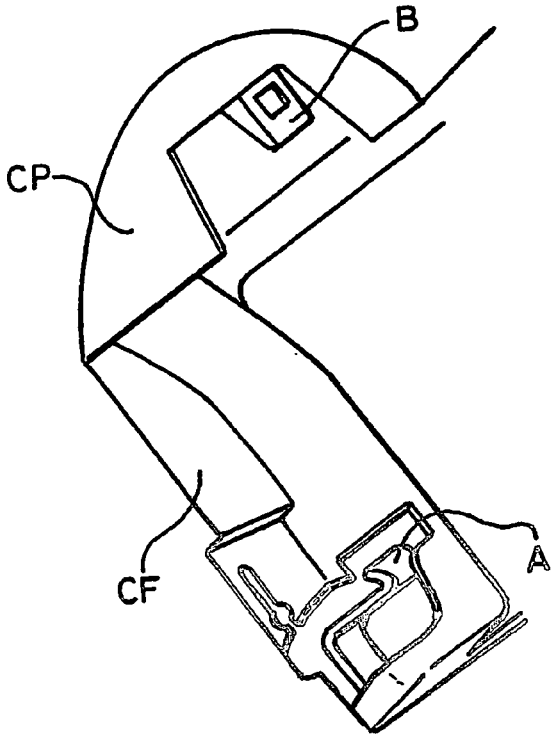
FIGS. 20*a-e* show an alternative type of locking mechanism.
Figure 20B:
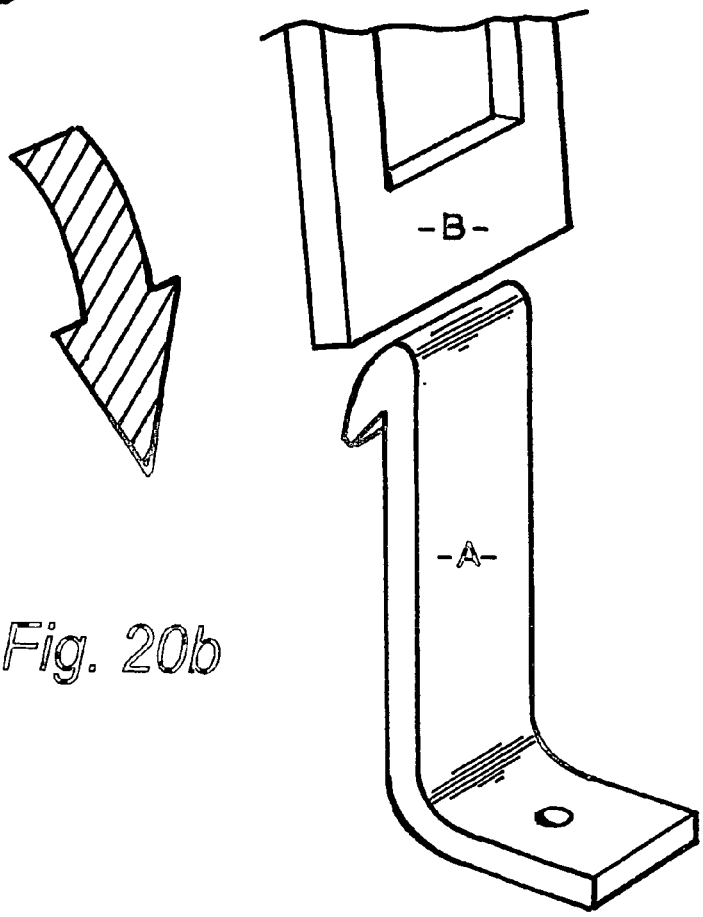
Figure 20C:
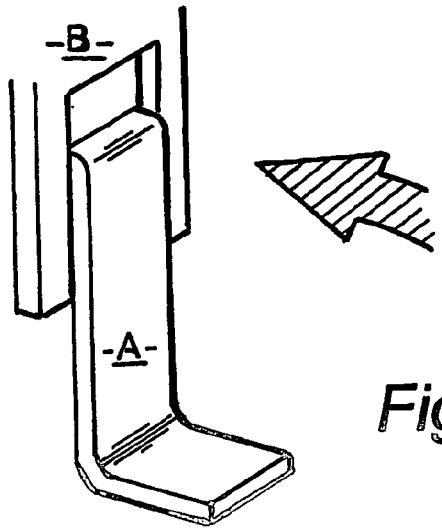
Figure 20D:
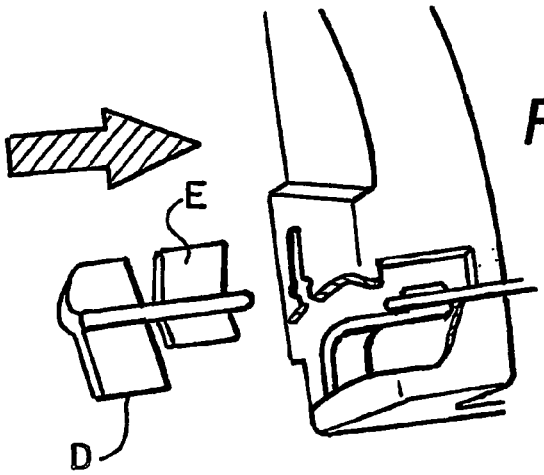
Figure 20E:
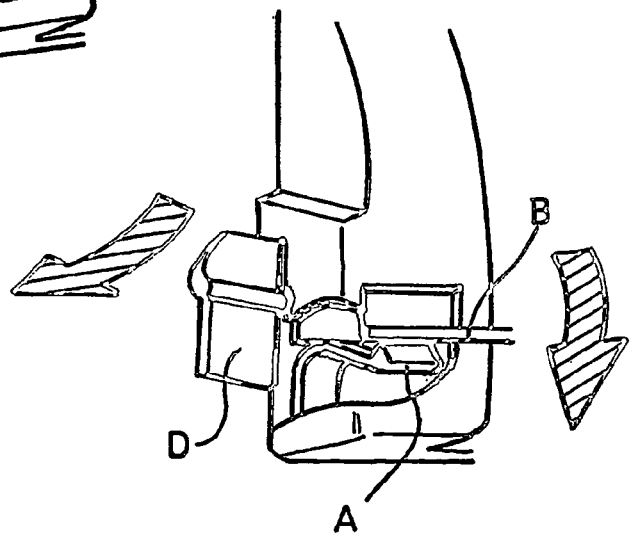

FIG. 20*a* shows the cover panel (CP) in the open position with a flexing latch arm (A) on the base plate or frame (CF) of the cover and a retaining member/clasp (B) on the underside of the cover panel (CP). FIG. 20*b* shows how the clasp (B) engages with the tip of the latch arm (A) as the cover panel (CP) is closing. FIG. 20*c* shows the clasp (B) and latch arm (a) fully engaged corresponding to the closed position of the cover panel (CP). FIG. 20*d* shows a key (D) being inserted and located in its barrel prior to turning to release the latch arm (A). FIG. 20*e* shows the movement of the key blades (E) against the latch arm (A) as the key (D) is being turned to release the latch arm (A) allowing the cover panel (CP) to open. This locking mechanism may be used with any of the embodiments previously described.

Referring now to FIGS. 21*a-e*, there is shown yet another locking mechanism for a detachable cover in which the cover frame (CF) is U-shaped to slide behind the faceplate (not shown) of a socket and be secured by the faceplate as described in our UK Patent No. 2366457.

Figure 21A:
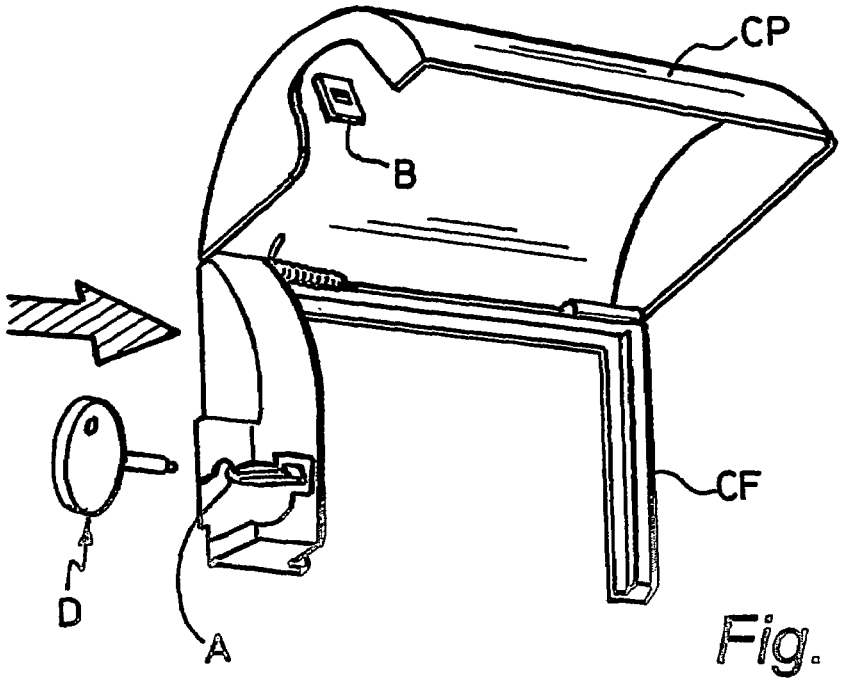
FIGS. 21*a-e* show yet another type of locking mechanism in a detachable cover according to the invention.
Figure 21B:
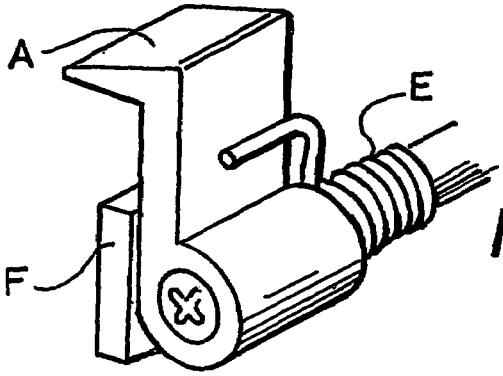
Figure 21C:
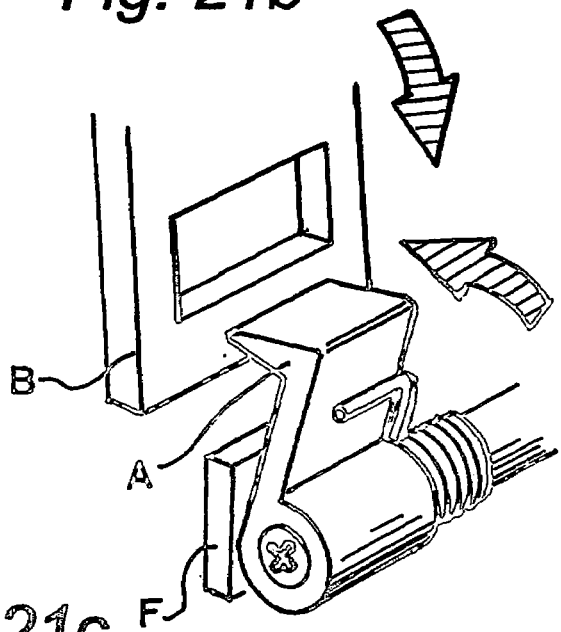
Figure 21D:
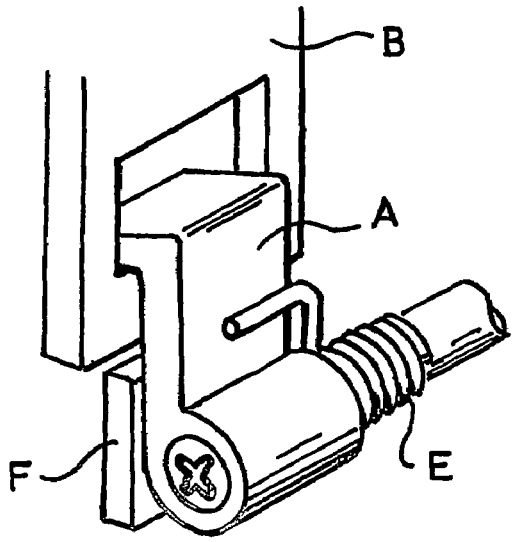
Figure 21E:
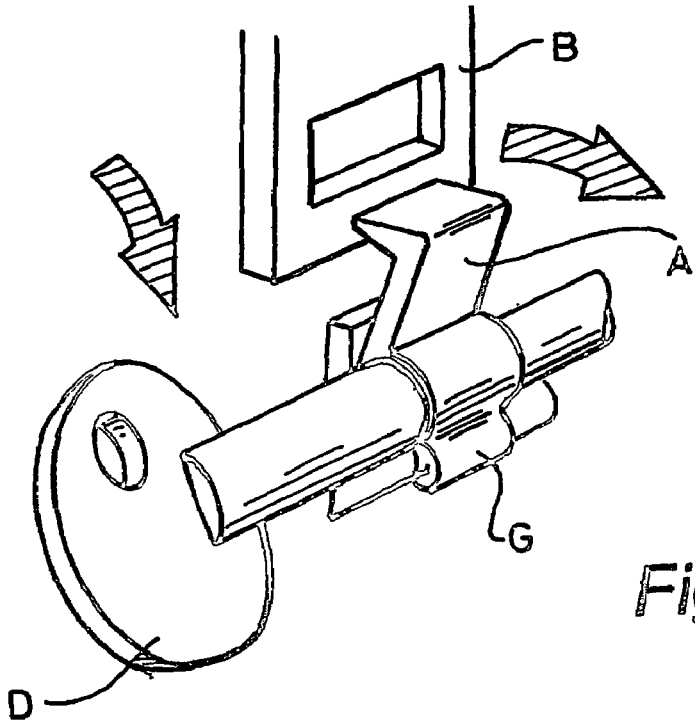

FIG. 21*a* shows the cover panel (CP) in the open position with the latch arm (A) on the frame (CF) and the retaining member/clasp (B) on the cover panel (CP) as described previously. FIG. 21*b* shows the latch arm (A) mounted on an axle and a torsion spring (E) arranged to bias the latch arm (A) to a vertical position engaging a stopper (F). FIG. 21*c* shows the clasp (B) engaging the tip of the latch arm (A) as the cover panel (CP) closes to move the latch arm (A) against the spring bias. FIG. 21*d* shows the clasp (B) and latch arm (A) engaged under the spring bias when the cover panel (CP) is in the closed position. FIG. 21*e* shows a male key (D) inserted into a female barrel on the axle and rotational movement of the axle as the key (D) is being turned to release the latch arm (A) and allow the cover panel (CP) to open. FIG. 21*e* also shows the axle with 'sprung tail' (G) as an alternative to the torsion spring (E).

Figure 22A:
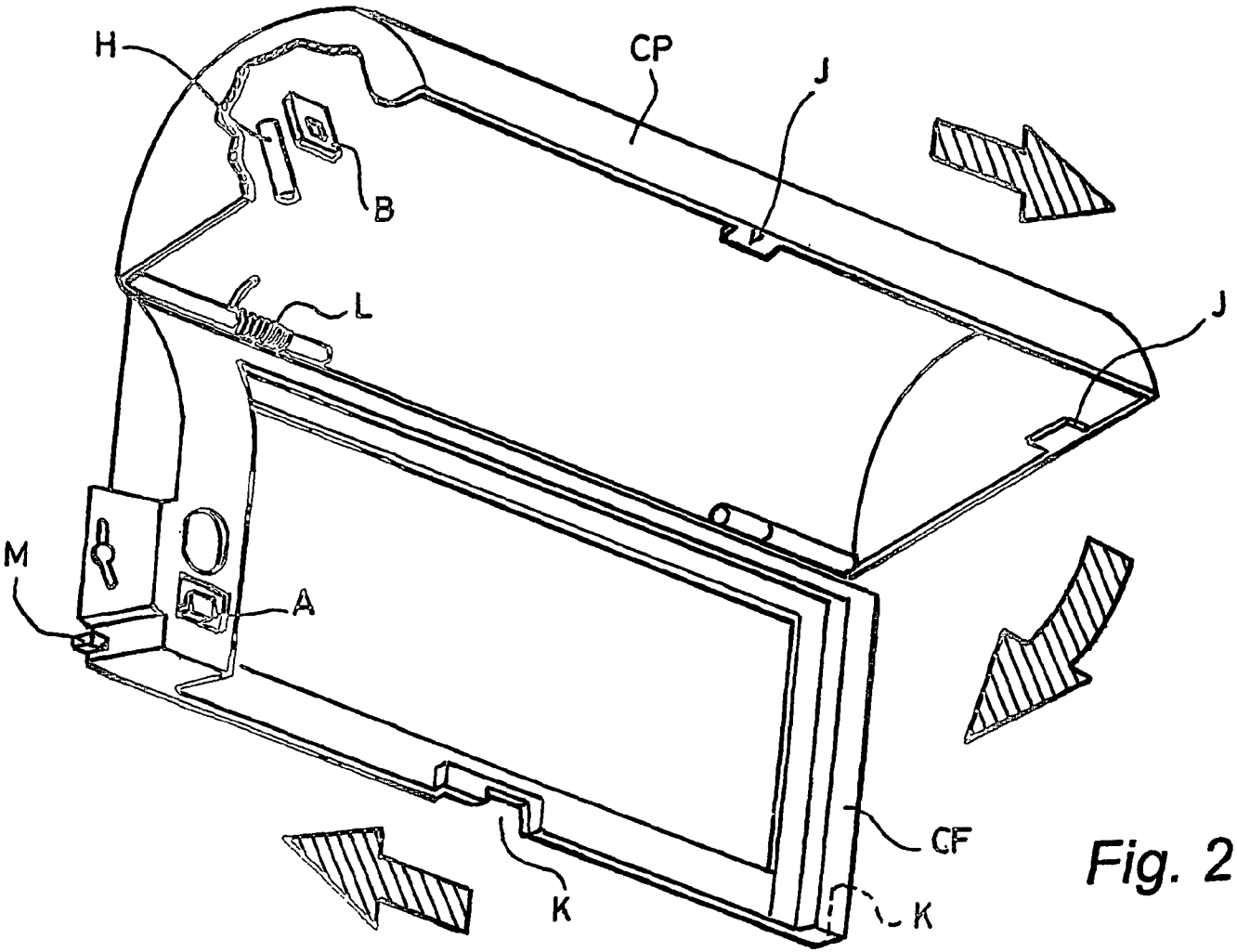
FIGS. 22*a-c* show a modification to the locking mechanism of FIGS. 20*a-e* in a detachable cover according to the invention.
Figure 22B:
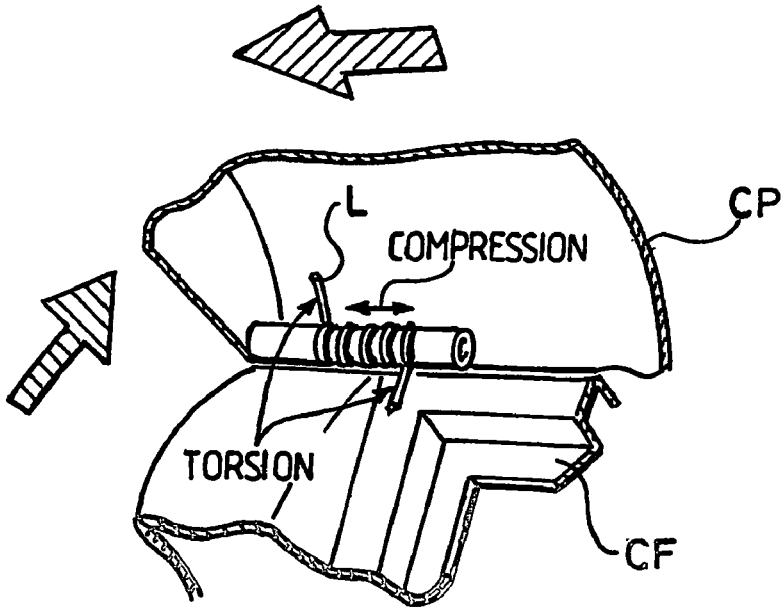
Figure 22C:
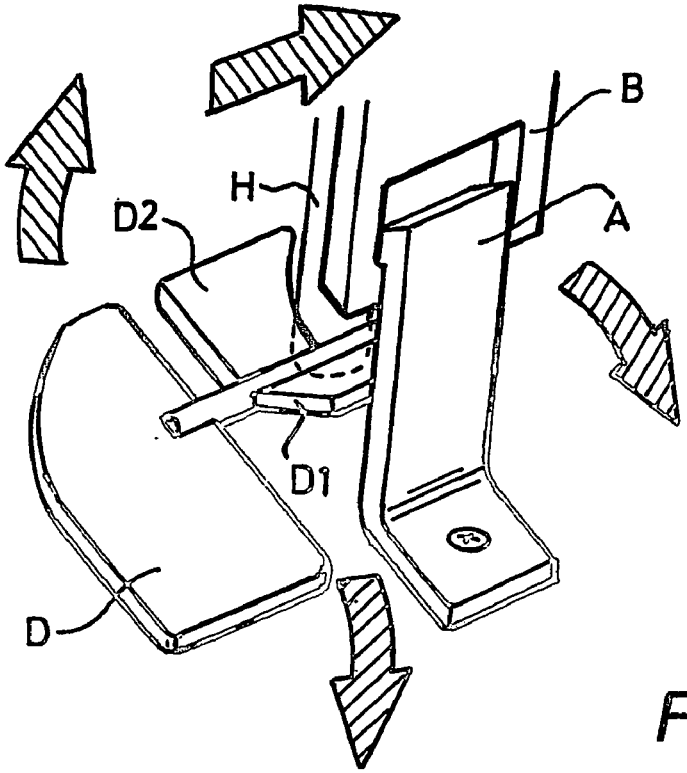

Referring now to FIGS. 22*a-c*, there are shown modifications to the cover and locking mechanism of FIGS. 20*a-e*. For convenience, like reference numerals are used to indicate corresponding parts where appropriate.

FIG. 22*a* shows the cover panel (CP) in the open position with clasp (B) on the underside for engagement with the spring loaded latch arm (A) on the cover frame (CF) in the closed position. The cover panel (CP) also has a post (H) on the underside adjacent to the clasp (B) that is received in an opening (I) on the cover frame (CF) when the cover panel (CP) is closed. The cover panel (CP) is also provided with inwardly directed lugs (J) located around the periphery to co-operate with latching points (K) on the cover frame (CF) in the closed position to prevent additional security in the closed position.

FIG. 22*b* shows the combined torsion/compression spring (L) that biases the cover panel (CP) for rotational movement about the hinge axis towards the open position and for axial movement parallel to the hinge axis towards a locked position. When the cover panel (CP) is in the open position, the spring (L) biases the cover panel (CP) to the left as viewed in FIG. 22*a*. On closing the cover panel (CP) radiused edges of the lugs (J) contact radiused edges of the latching points (K) to move the cover panel (CP) to the right against the biasing of the spring (L) until the lugs (J) enter the latching points (K) allowing the cover panel (CP) to slide to the left and engage the lugs (J) with the latching points (K) to prevent the cover panel (CP) opening.

In this condition, the cover panel (CP) is not fully closed and on, further movement towards the closed position, the clasp (B) engages the latching arm (A) as described previously to secure the cover panel (CP) in the closed position. In this way, a double locking action is provided by engagement of the lugs (J) and clasp (B) on the cover panel (CP) with the latching points ((K) and latching arm (A) on the cover frame (CF). In the closed position, the cover panel (CP) is prevented from being slid axially against the biasing of the spring (L) to release the engagement of the lugs (J) with the latching points (K) by engagement of a detent (M) with the cover panel (CP).

FIG. 22*c* shows release of the double latch to open the cover by means of a key (D). The key (D) has a pair of radial arms (D1,D2). The arm D1 engages the latch arm (A) on initial rotation of the key to release the clasp (B) on the cover panel (CP). This allows the cover panel (CP) to move away from the closed position sufficiently for the cover panel (CP) to clear the detent (M) while still prevented from moving to the open position by engagement of the lugs (J) with the latching points (K) around the perimeter of the cover panel (CP).

On continued rotation of the key (D), a cam face on the other arm (D2) engages the post (H) on the underside of the cover panel (CP) to displace the cover panel (CP) sideways parallel to the hinge axis against the biasing of the spring (L) until the lugs (J) are clear of the latching points (K) allowing the cover panel (CP) to move freely to the open position under the biasing of spring (L).

In the open position, the lugs (J) and latching points (K) are misaligned so that the radiused edged contact each other on closing the cover panel (CP) as described previously. As will be appreciated, the double latching arrangement provides additional security against forcing of the cover panel (CP) in the closed position.

FIGS. 23*a-d* show the application of the double latching arrangement of FIGS. 22*a-c* to the locking mechanism of FIGS. 21*a-e* in a detachable cover according to the present invention and again like reference numerals are used to indicate corresponding parts where appropriate.

Figures 23A, 23D:
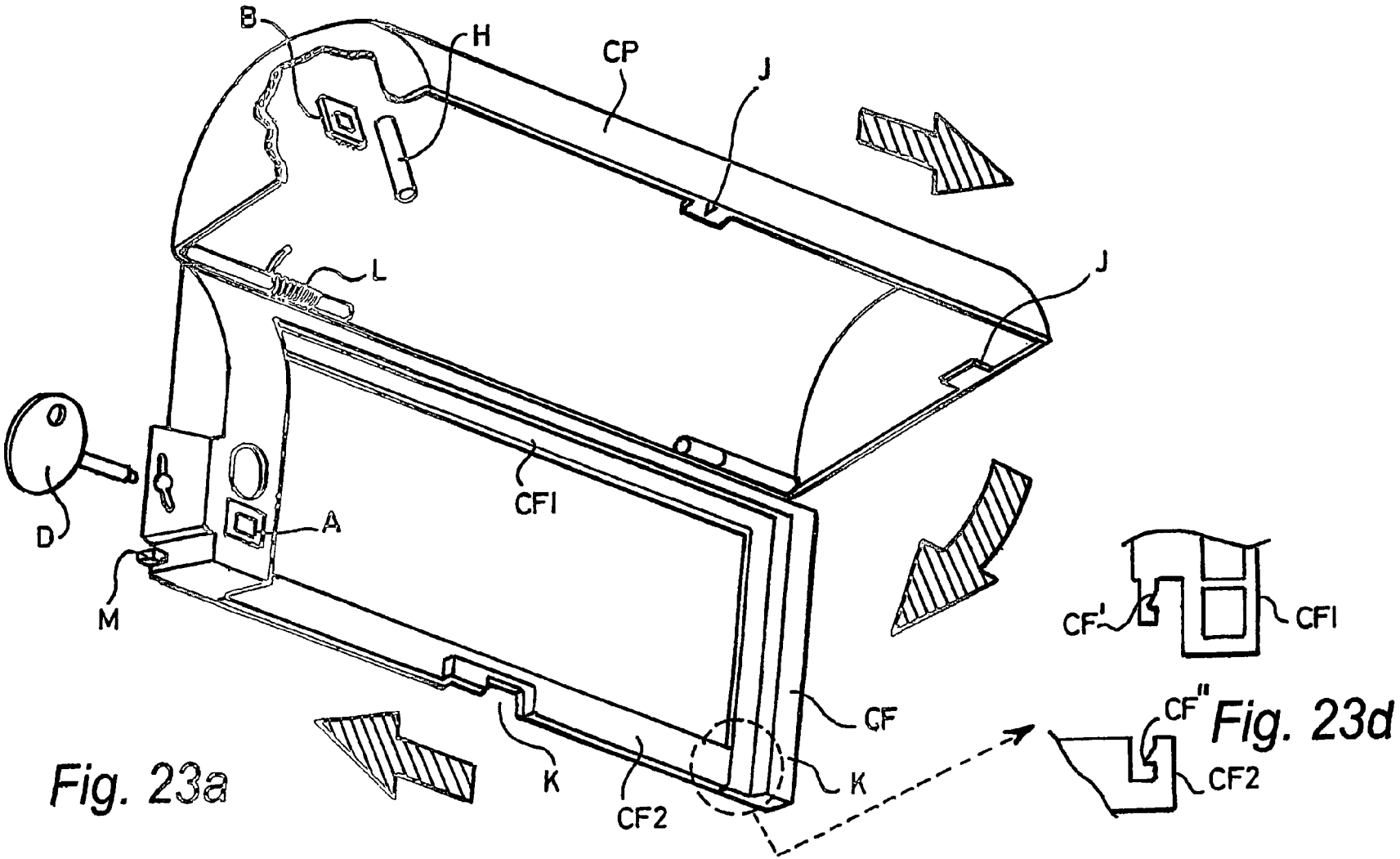
FIGS. 23*a-d* show a modification to the locking mechanism of FIGS. 21*a-e;*

As shown in FIG. 23*a* the cover frame (CF) has four sides to extend all the way around the perimeter of a double socket (not shown). The frame (CF) comprises a U-shaped member (CF1) that extends across the top and down both sides of the socket as shown in FIG. 21*a* and a base member (CF2) that extends between and is releasably connected to the outer ends of the legs of the U-shaped member on each side of the frame.

Any suitable connection may be provided, for example interengageable mating formations (CF',CF") that clip together (see FIG. 23*d*). The frame (CF) can be assembled without removing the faceplate of the socket from the wall and arranged so that the interengageable formations are located behind the faceplate in the mounted position of the cover. The cover frame (CF) shown in FIG. 22*a* may be of similar construction.

Figure 23B:
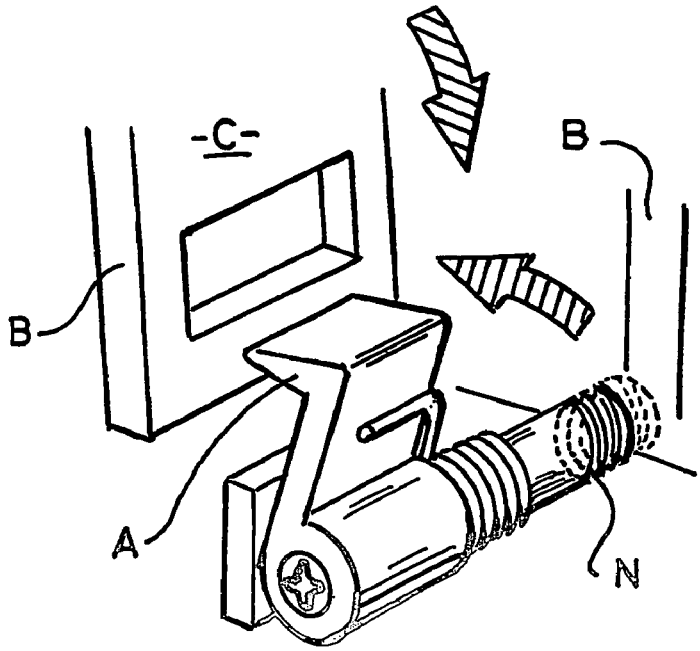

As shown in FIG. 23*b*, the axle mounting the latch arm (A) is attached to the base of the cover frame (CF) by means of a threaded screw (N). On initial rotation of the axle by means of a key (D) with the cover panel (CP) in the closed position, the latch arm (A) is released from the clasp (B) allowing the cover panel (CP) to open slightly to clear the detent (M).

On continued rotation of the key (D) the axle moves axially due to the threaded mounting to engage the post (H) to move the cover panel (CP) sideways parallel to the hinge axis until the lugs (J) clear the latching points (K) around the perimeter of the cover panel (CP) allowing the cover panel (CP) to move freely to the open position.

Figure 23C:
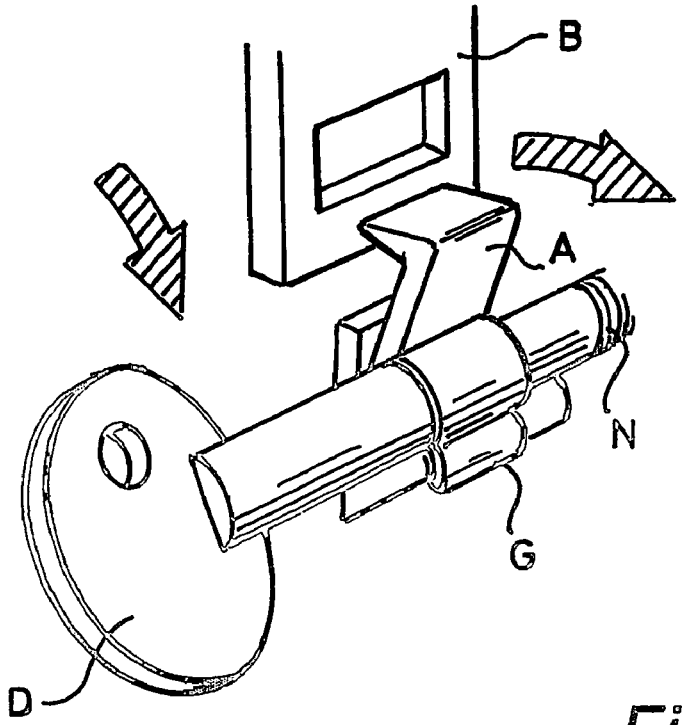
Figure 24A:
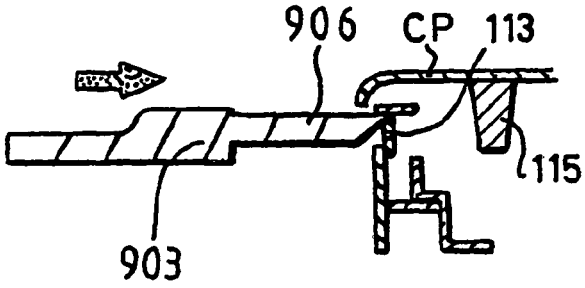
FIGS. 24*a-e* show a modification to the locking mechanism of FIGS. 16*a-d;*
Figure 24B:
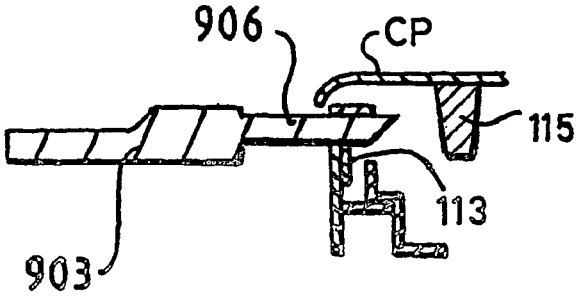
Figure 24C:
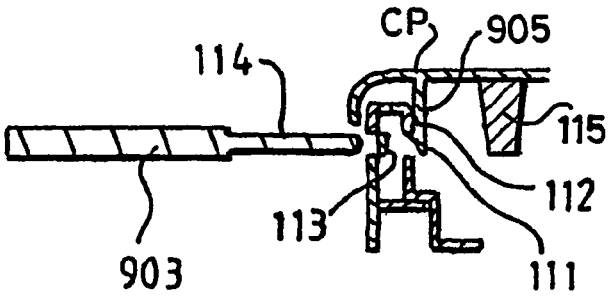
Figure 24D:
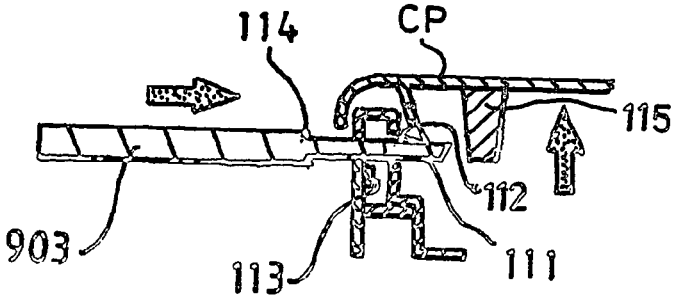
Figure 24E:
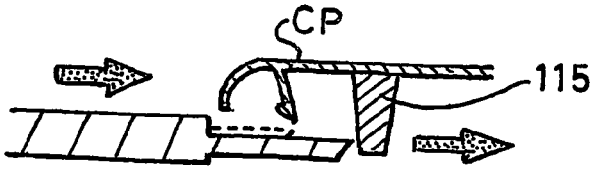

The axle returns to its original position on removal of the key (H) allowing the lugs (J) and clasp (B) to engage the latching points (K) and latch arm (A) when the cover panel (CP) is next closed as described previously. FIG. 23*c* shows the axle with a "sprung tail" (G) in place of the torsion spring (E) as described previously.

The application of the double latching described above with reference to the locking mechanisms of FIGS. 22 and 23 can be applied to the other versions of locking mechanism described herein.

FIGS. 24*a-e* show its application to the locking mechanism of FIGS. 16*a-d*. As shown, the centre prong (906) of the key (903) initially displaces the shutter (113) to allow entry of the prongs (114) to release the latch arms (112)

enabling the cover panel (CP) to partially open in the direction of arrow A to clear the detent (not shown) blocking sideways movement of the cover panel in the closed position. On further insertion of the key, the centre prong (906) engages the post (115) on the underside of the cover panel (CP) and moves the cover panel sideways parallel to the hinge axis until the perimeter lugs (not shown) clear the latching points (not shown) allowing the cover panel (CP) to move freely to the open position as described previously.

Figure 25A:
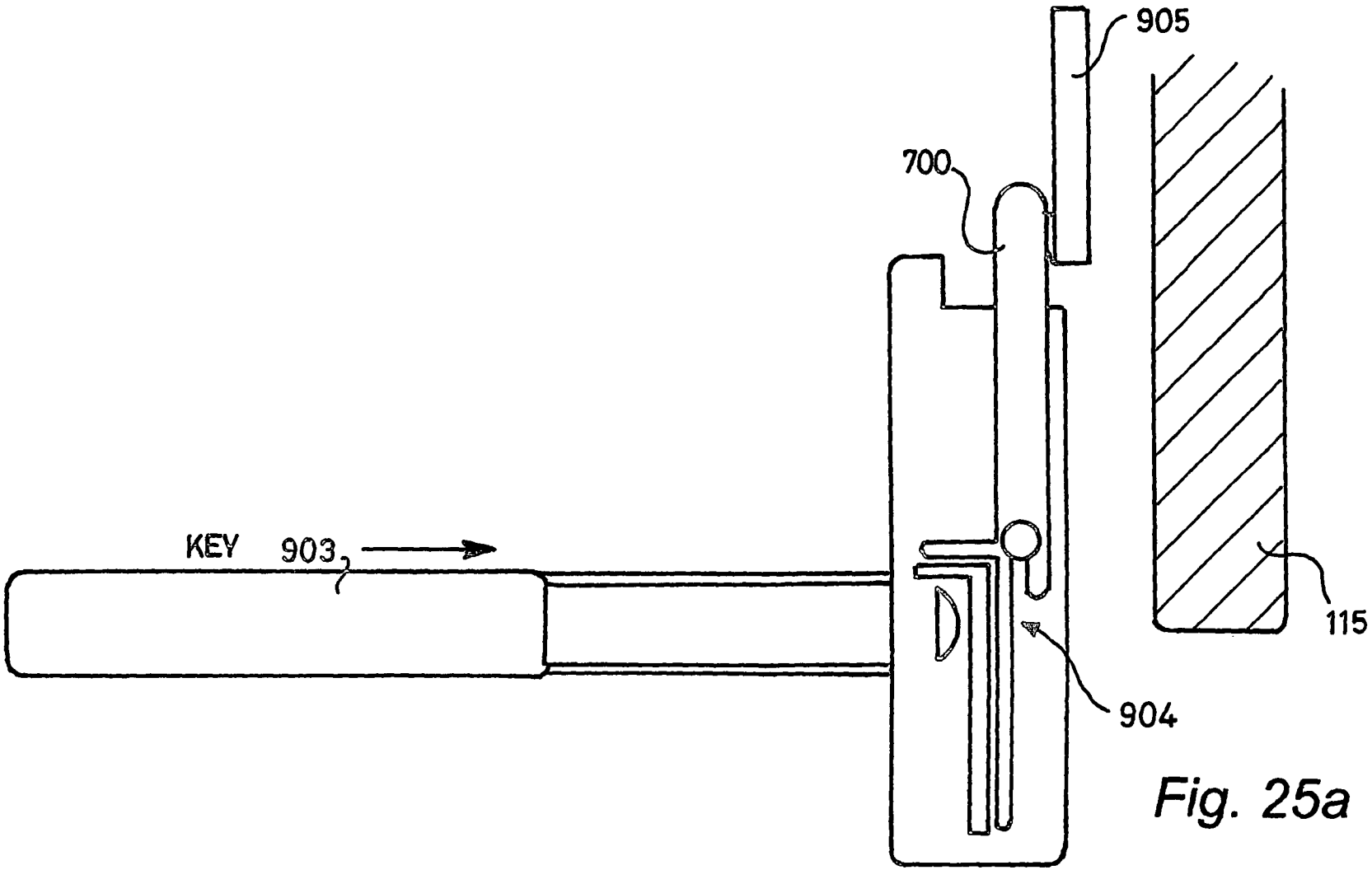
FIGS. 25*a* & 25*b* show a modification to the locking mechanism of 13 to 15.
Figure 25B:
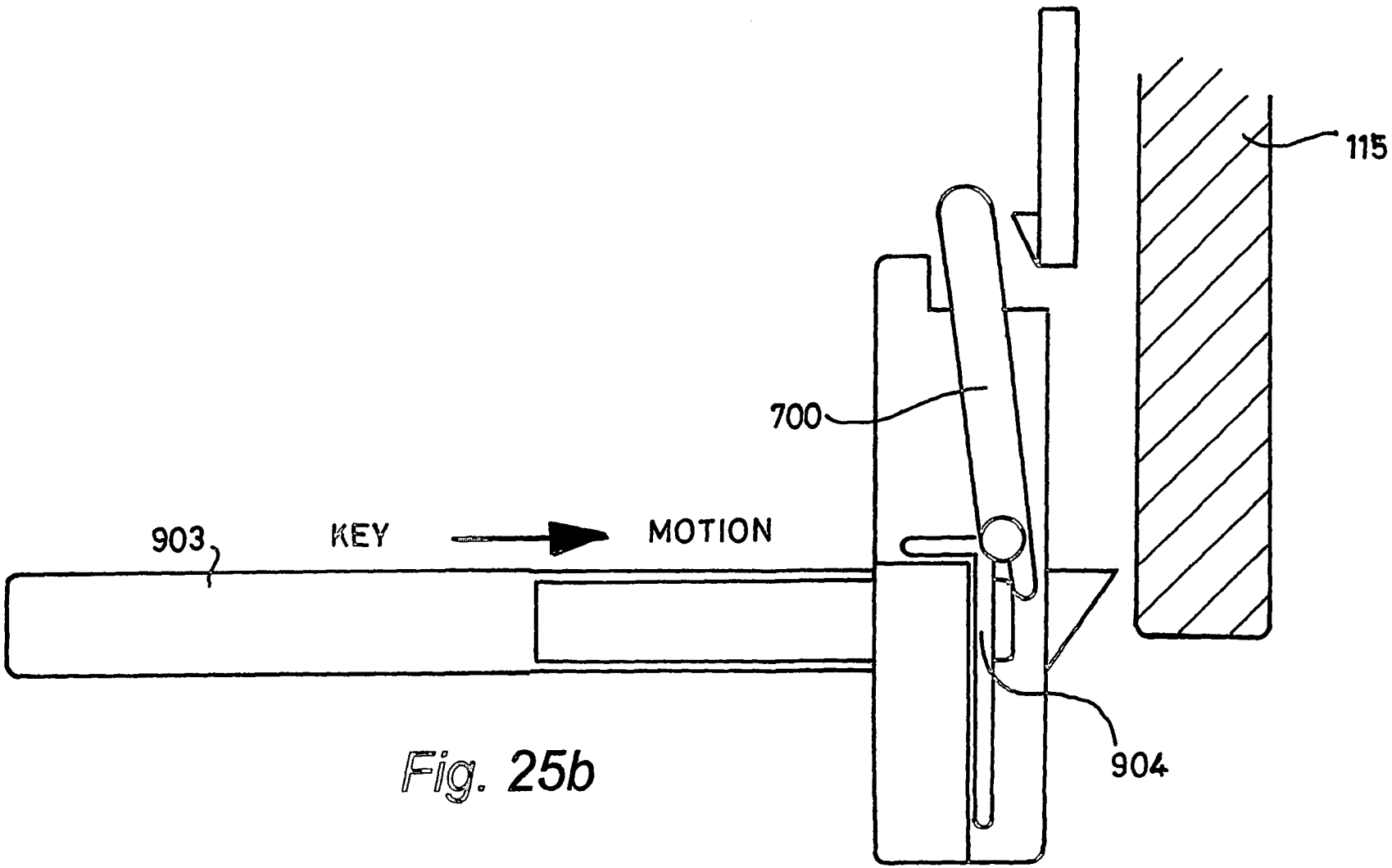

FIGS. 25*a* & 25*b* show its application to the locking mechanism of FIGS. 13 to 15. As shown, the centre prong of the key (903) again opens the apertures (904) allowing the outer prongs to release the detents (905 from the eyelets (700) to enable the cover panel to open partially and thereafter the centre prong engages the post (115) on cover panel to move the cover panel sideways to disengage the perimeter lugs (not shown) from the latching points (not shown) on the cover frame to allow the cover panel to move freely to the open position as described previously.

Figures 26A, 26B:
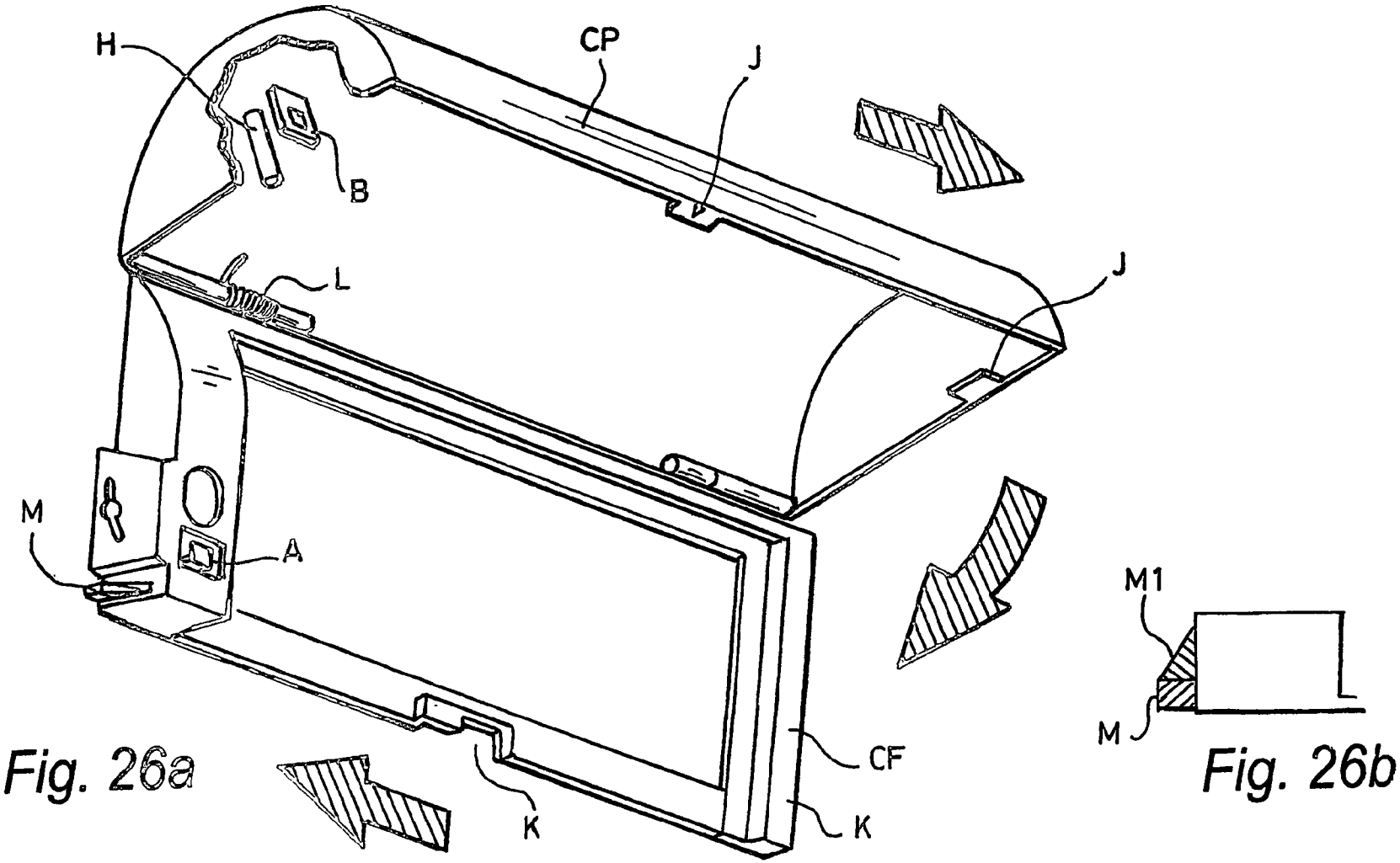
FIGS. 26*a* & 26*b* show a modification to the locking mechanism of FIGS. 22*a-c* in a detachable cover according to the invention.

Referring now to FIGS. 26*a* & 26*b*, there is shown a modification to the double latching locking mechanism of the detachable cover shown in FIGS. 23*a-d*. In this embodiment, the detent (M) on the cover frame (CF) to prevent sideways movement of the cover panel (CP) in the closed position is provided with an angled cam extension (M1) of triangular shape that co-operates with the perimeter edge of the cover panel (CP) as it is closed to move the panel sideways (to the left ads viewed in FIG. 26*a*) on closing the cover panel (CP) to ensure the lugs (J) fully engage the latching points (K) in the closed position.

With this arrangement, the axial biasing provided by the compression/torsion spring (L) can be reduced with potential benefits by allowing spring torsion strength to open the cover panel (CP) to be optimised combined with improved spring life from reduced wear and degradation of the spring (L) in use. The above modification may be applied to any of the other double latching mechanisms described herein.

Figure 27A:
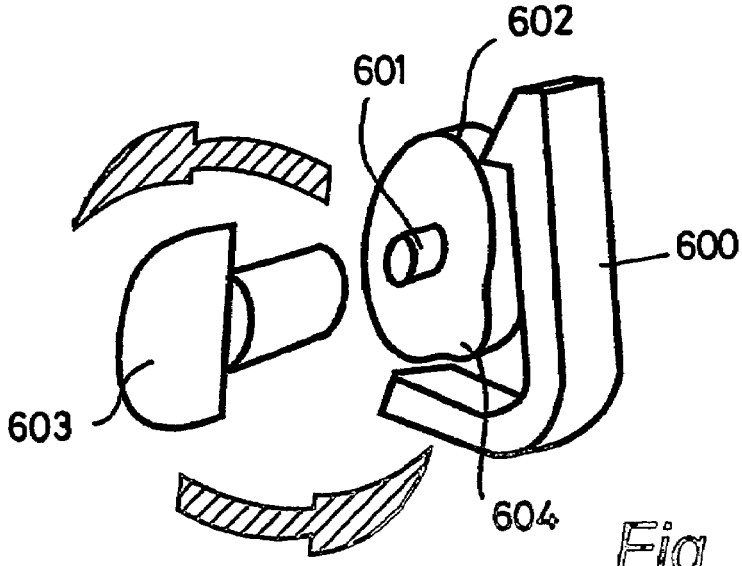
FIGS. 27*a* & 27*b* show an alternative form of locking mechanism.
Figure 27B:
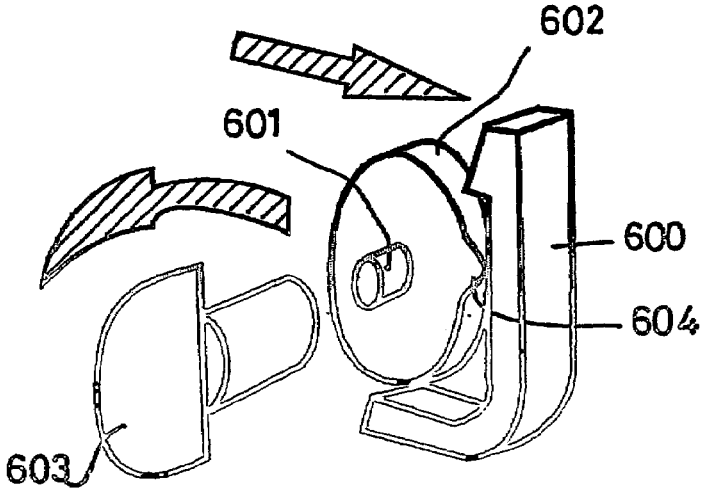

Turning now to FIGS. 27*a* & 27*b*, there is shown another variant of the locking mechanisms described herein. In this embodiment, a flexible latch arm (600) on the cover frame (not shown) is engageable with a clasp (not shown) on the underside of the cover panel (not shown) to secure the cover panel in the closed position. An axle (601) carries a cam shaped disc (602) and is rotated by insertion of a key (603) to cause a cam lobe (604) on the disc (602) to displace the latch arm (600) in the direction of the arrow (A) to release the clasp.

This action may completely release the cover panel for movement to the open position or partially release the cover panel with a further action required to disengage additional latch means such as the perimeter latching points described above to fully release the cover panel. With this arrangement, the latch arm does not lie on the same axis or plane as the key barrel through which the key passes to engage the axle. In this way the latch arm (or other suitable latching means) is shielded within the cover and protected out of reach from instruments or tools which may be deployed in an attempt to gain unauthorised access to the cover.

Figure 28A:
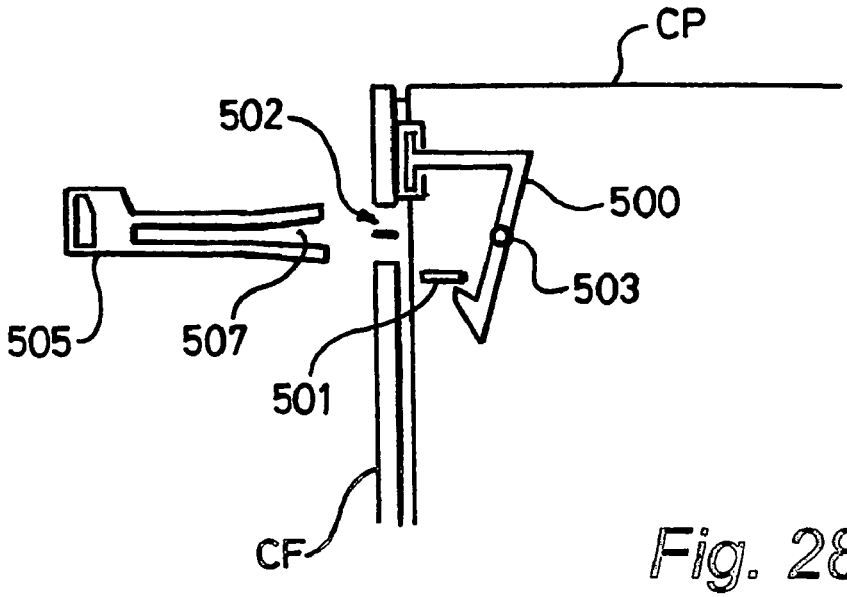
FIGS. 28*a-c* show another form of locking mechanism.
Figure 28B:
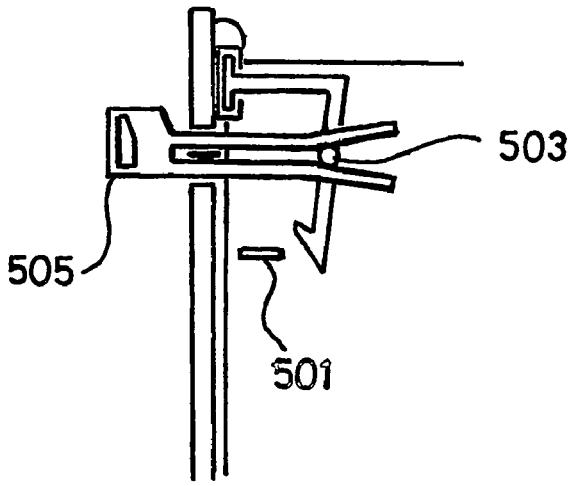
Figure 28C:
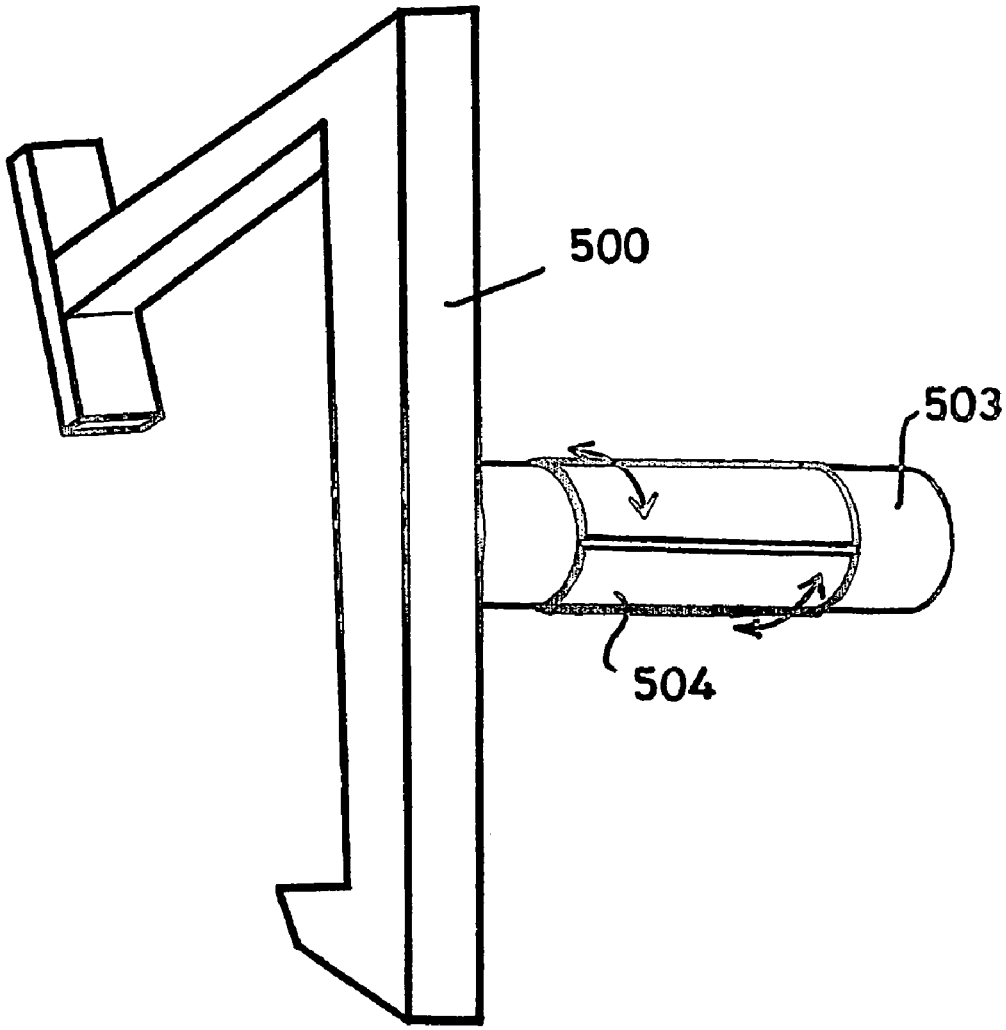

Referring now to FIGS. 28*a-c*, there is shown yet another variant of the locking mechanism described herein. In this embodiment, a flexible latch arm (500) on the cover frame (CF) is engageable with a clasp (501) on the cover panel (CP) to secure the cover panel (CP) in the closed position. The latch arm (500) is offset to one side of a two-prong hole (502) in the cover frame (CF) or a three prong hole if a shutter is employed as described previously to cover the hole (502) in the closed position.

The latch arm (500) has an integral finger (503) that extends transversely and is aligned with the hole (502). The finger (502) is cylindrical and carries a sleeve (504) that is freely rotatable on the finger (502). A key (505) with two prongs (or three if a shutter is employed) is inserted through the hole (502) towards the finger (503).

The prongs define a slot (507) in which the finger (503) is received. The slot (507) is tapered so that the prongs compress the sleeve (504) so that it grips the finger (503) allowing the latch arm (500) to be displaced to release the clasp (501). If an attempt is made to release the latch arm (500) by inserting a tool such as screwdriver into the hole (504) to move the finger (503), the tool will contact the sleeve (504) which rotates on the finger (503) preventing the application of a pushing force to displace the finger (503) to release the latch arm (500).

Figure 29:
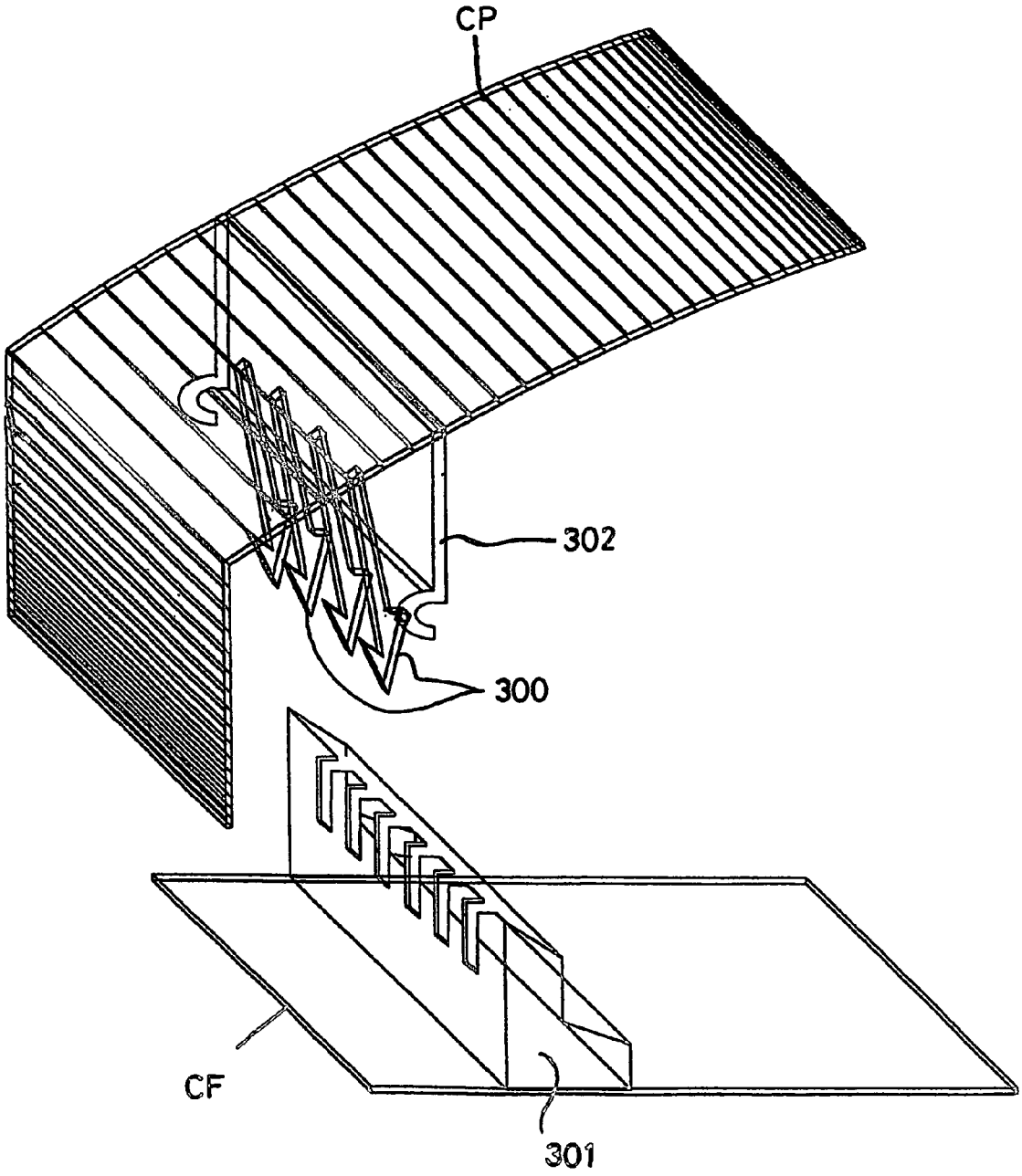
FIG. 29 shows another type of locking mechanism.

Referring now to FIG. 29 a still further version of a locking mechanism is shown. In this embodiment, the cover panel (CP) has a plurality of flexible latch arms (300) engageable with a retainer (301) on the cover frame (CF) to secure the cover panel (CP) in the closed position. The over panel (CP) is provided with a profiled slot (302) into which a portion of each latch arm (300) extends.

A key (not shown) having a profile matching that of the slot (302) can be slid lengthwise of the slot (302) in similar manner to a card operated "swipe" lock to cause the latch arms (300) to disengage the retainer (301) and release the cover frame (CF) for movement to the open position. The latch arms (300) automatically re-engage the retainer (301) when the cover panel (CP is next closed. The length of the slot (302) and the number of latch arms (300) can be chosen as desired.

Figure 30:
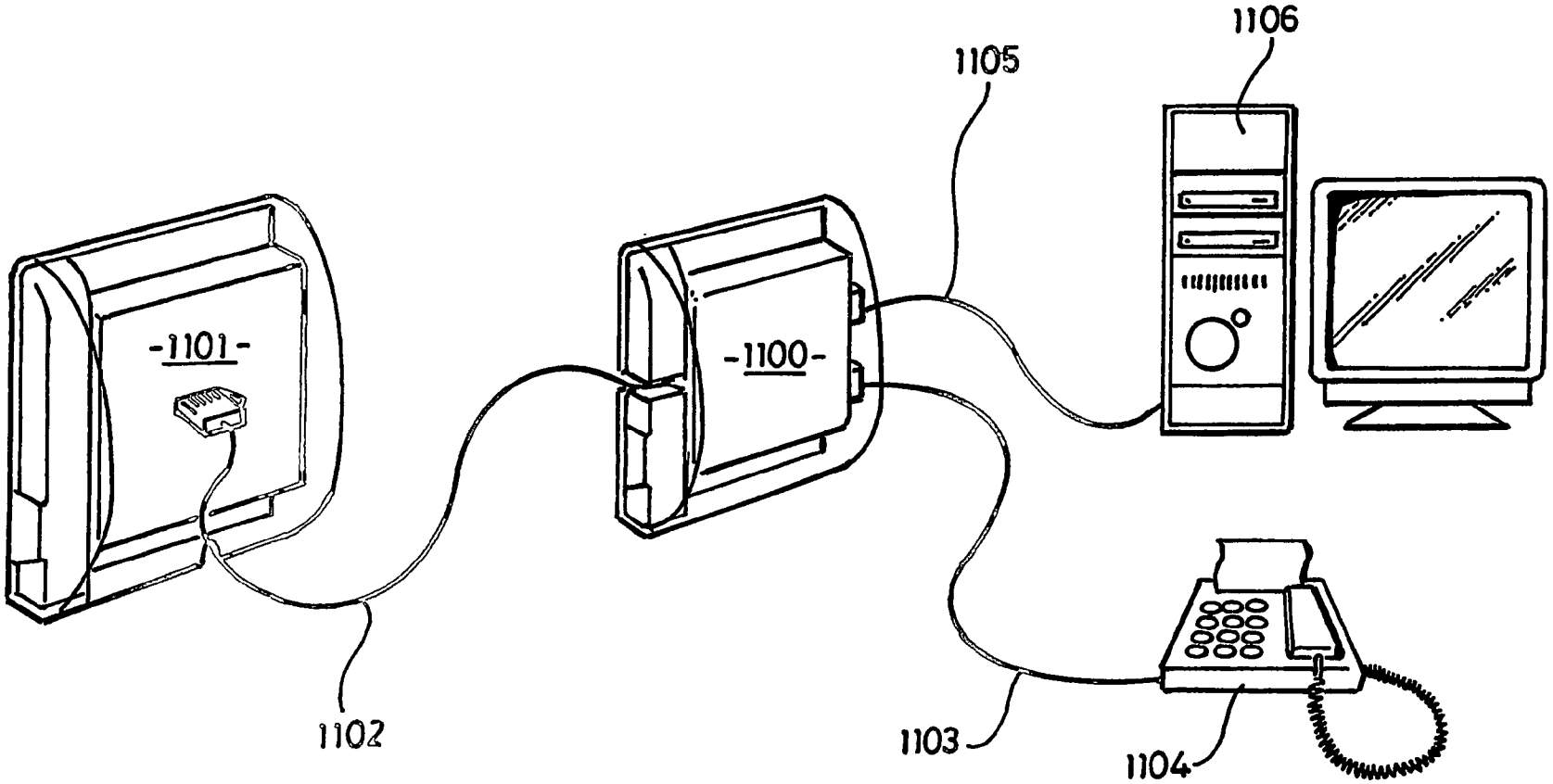
FIG. 30 shows another application of the invention.

Referring now to FIG. 30, there is illustrated application of the lockable cover of the invention to voice and data appliances such as telephones, facsimile machines and computers that are connected to telephone and data networks.

A splitter device (1100) is connected to a standard telephone socket (1101) by way of a cable (1102). In this embodiment, the splitter device is a modem (1100) with a splitter circuit, that is one circuit to carry voice and another circuit to carry data. It will be understood however that other splitter devices could be employed, for example a DSL filter. The modem (1100) is connected by a cable (1103) to a telephone/fax machine (1104)—the voice cable—and by a cable (1105) to a computer (1106)—the data cable.

By deploying a lockable cover (not shown) such as described herein over the modem (1100), the user can choose whether to allow unsupervised connections to the telephone, fax via the telephone or voice cable (1103) and/or the Internet via the data cable (1105). Thus, if the user wishes to ensure only the telephone (1104) remains connected, then the cable (1103) from the telephone (1104) can be inserted into the modem splitter and the lockable cover fitted to prevent connection of the cable (1105) for the computer (1106). Similarly, connection to the internet may be provided by connecting the cable (1105) and use of the telephone/fax prevented by fitting the lockable cover without attaching the cable (1103).

This solution is desirable for parents or businesses who wish to control access to any combination of these appliances and the consequences that may arise from unsupervised usage. Using a simple lockable cover obviates the need for electronic programming of devices, such as installing software or configuring passwords to control Internet access from a computer. The computer or data device functions are unaffected, with the exception of data exchange through the Internet modem.

The lockable cover may be any of the types described herein ie a detachable accessory or an integral part of the frame and the lock can be any of the kinds described herein.

As described thus far, the locking mechanisms for releasably securing the cover panel in the closed position are mechanically operable by means of a key or similar actuator device. It will be understood however, that the invention is not limited to such mechanical operation and that the cover could include a powered locking mechanism such as a mains or battery powered electrically operable locking mechanism.

Figure 31:
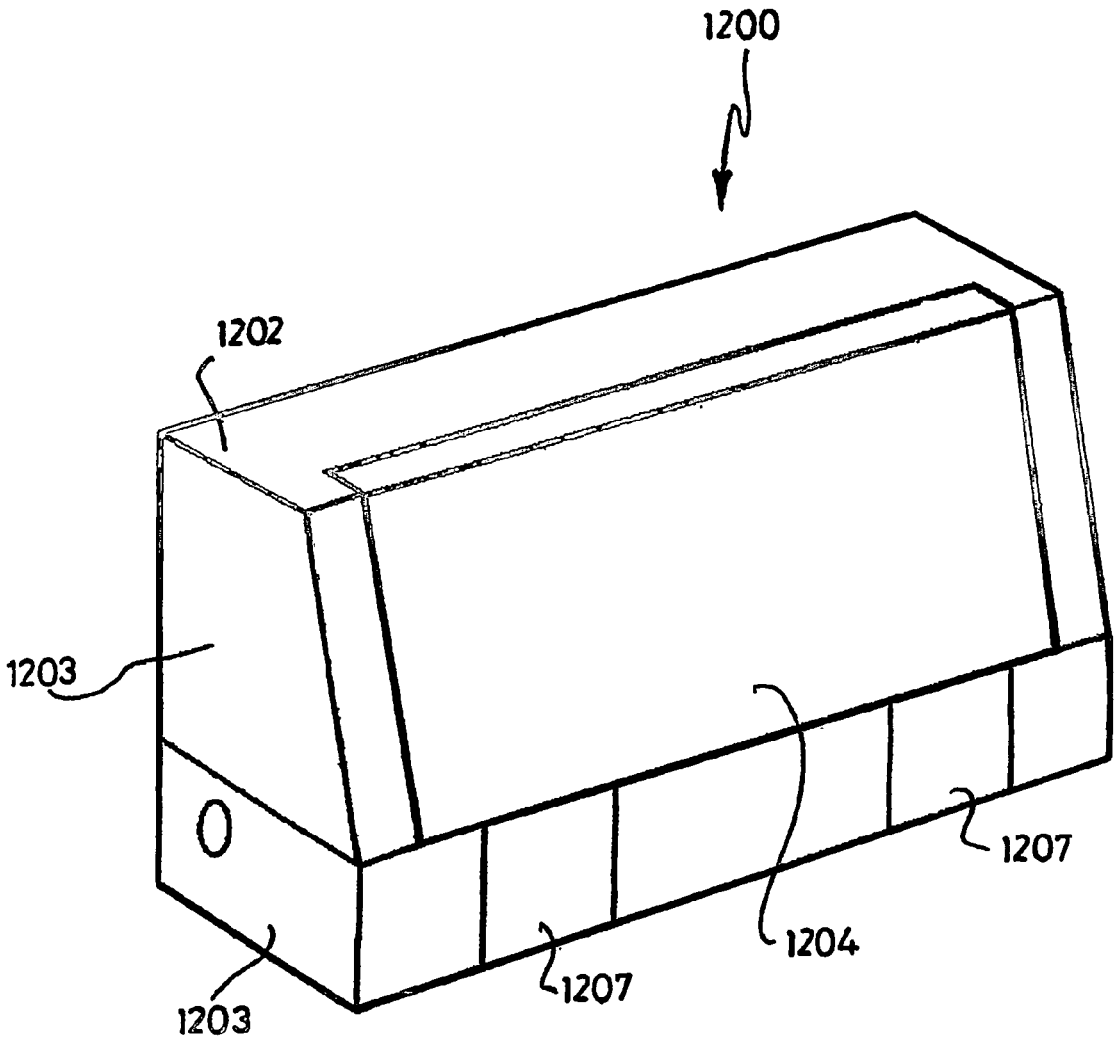
FIG. 31 shows a perspective view of another detachable lockable cover according to the invention with the cover panel in the closed position.
Figure 32:
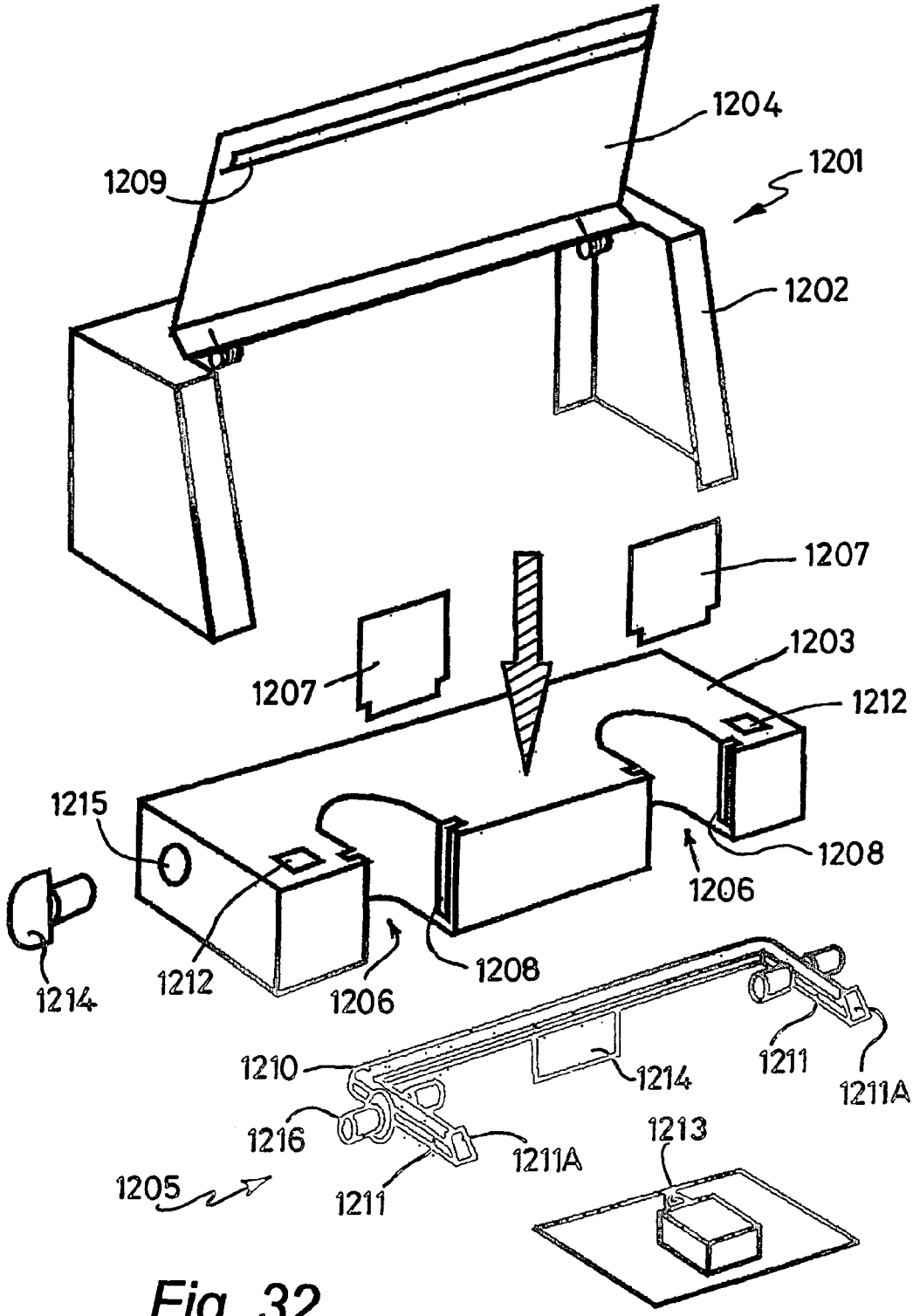
FIG. 32 is an exploded perspective view of parts of the cover shown in FIG. 31 with the cover panel in the open position.

One such arrangement is shown in FIGS. 31 and 32, where a cover (1200) for a double socket (not shown) comprises a frame (1201) for mounting between a faceplate of the socket and a wall mounting box as described previously.

The frame (1201) has an upper part (1202) and a lower part (1203). The upper part (1202) is provided with a cover panel (1204) that is movable between a closed position shown in FIG. 31 to conceal the socket and an open position shown in FIG. 32 allowing access to the socket.

The lower part (1203) is hollow and houses the locking mechanism (1205) for securing the cover panel (1204) in the closed position. The lower part (1203) is provided with a pair of recesses (1206) in the front face for passage of cable leads (not shown) connected to plugs (not shown) attached to the socket.

The recesses (1206) are closed at the front edge of the lower part by cable tie plates (1207) that are a push fit in grooves (1208) to retain the cables in the recesses (1206). The upper edges of the tie plates (1207) are concealed by the cover panel (1204) in the closed position and the tie plates (1207) are retained in position by a rib (1209) on the underside of the cover panel (1204).

In use, if the cables are pulled, the cable tie plates (1207) transfer the applied forces to the securely mounted frame (1200) which is able to withstand the loads. In this way, the application of loads to the plugs and/or cover panel (1204) such as may disconnect the plugs and/or force open the cover panel (1204) can be avoided. A similar arrangement may be applied to any of the covers described herein.

The locking mechanism (1205) includes a U-shaped latch member (1210) pivotally mounted within the lower part (1203) of the frame (1200). The latch member (1210) has a pair of latch arms (1211) and is pivotal between a latching position in which hooked ends (1211A) of the arms (1211) project through holes (1212) in the upper surface of the lower part (1203) and a release position in which the hooked ends (1211A) are withdrawn into the lower part (1203).

The latch member (1210) is biased to the latching position by a spring (not shown) and is movable against the biasing to the release position by actuation of a solenoid operated piston rod (1213). The piston rod (1213) is movable between extended and retracted positions according to actuation of the solenoid. The solenoid may be powered by a battery or by connection to the mains via suitable transformer.

In the retracted position, the latch member (1210) is biased to the latching position and a plate (1214) on the latch member (1210) contacts the end of the piston rod (1213). In this condition, the latch member (1210) can move away from the latching position in response to movement of the cover panel (1204) towards the closed position. In this way, the latch member (1210) automatically engages the rib (1209) on the underside of the cover panel (1204) when the cover panel (1204) returns to the closed position from the open position.

The latch member (1210) is movable to the release position against the biasing of the spring by actuation of the solenoid to extend the piston rod (1213) causing the latch member (1210) to pivot to lower the hooked ends (1211A) and release the cover panel (1204) which moves to the open position under its spring biasing.

The solenoid controlling the piston rod (1213) can be operated remotely by any suitable means such as by a radio signal or by an infra-red signal from an appropriate transmitter with a suitable sensor to receive the signal. The transmitter may be incorporated in a portable hand held device such as a key fob that may be programmed to operate more than one lockable cover, for example in installations in domestic or commercial environments where a plurality of lockable covers may be employed and control of access to some or all of these is required. Such portable hand held device may also be programmed to control over lockable fixtures or items in the home or office to restrict access to authorised users.

The latch member (1210) may also be operated manually by means of a key (1214) to allow the cover panel (1204) to be released in an emergency, for example if a power supply to the solenoid is interrupted. For this, the key (1214) may be inserted through a hole (1215) in the side of the lower part (1203) to engage a shaft (1216) for rotating the latch member (1210). The engagement between the key (1214) and shaft (1216) may be by any suitable formations, preferably male and female. The key operation may include features from any of embodiments previously described to improve security and reduce the risk of unauthorised release of the cover panel (1204).

As described thus far, embodiments of the invention with integral (built-in) cover and separate, detachable cover have a cover panel that is mounted for hinging movement between open and closed positions. There are circumstances, however, where it may be desirable to provide a cover panel that opens and closes along a flat plane of movement, that is, by the action of sliding movement, rather than hinging movement.

Such sliding cover panel may move up or down or from side to side and may either retract into the frame itself or protrude from the upper side, the lower side (or both upper and lower sides) or the left side, the right side (or both the left and right side) of the frame. The purpose of the sliding cover panel is to provide all the protection to plugs, sockets and switches afforded by previously described hinged cover panels whilst offering no additional obstruction away from the wall when in either the open or closed position.

For example, in circumstances where available space may not provide enough room for the cover panel to open outwards sufficiently to allow access to the socket or plug retained therein (such as behind a sofa or a set of drawers), it is desirable that the cover panel opens in a flat plane of motion (either up or down or from side to side) such that no additional space away from the wall is required for the cover to operate successfully.

Another application for a sliding cover panel, as opposed to a hinged cover panel that swings outwards, is where obstructions created by leaving a hinged cover panel in the open position may prove hazardous. Examples of such hazardous situations are areas where there is a lot of movement (such as a busy office) or where there are high risk or accident-prone groups nearby (such as in a nursery school or old peoples home), where an individual could suffer injury by tripping or falling over or onto such an open cover panel. Commercial premises with areas open to the general public may prefer a sliding cover panel as a means of reducing the likelihood accidents.

The cover with sliding cover panel may be provided as a separate unit that locates behind the faceplate of an existing plug socket wall fixture or as an integral part of a plug socket fixture as described in the previous embodiments.

Figure 33:
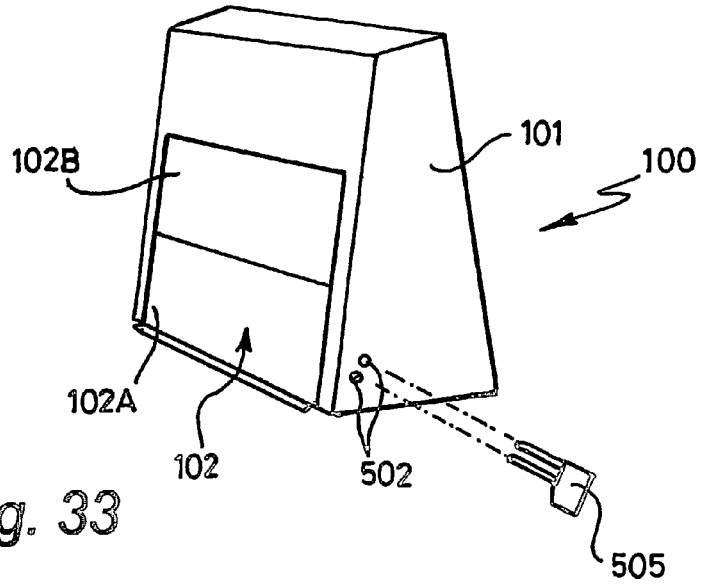
FIG. 33 shows a front perspective view of a detachable lockable cover with a sliding cover panel.
Figure 34:
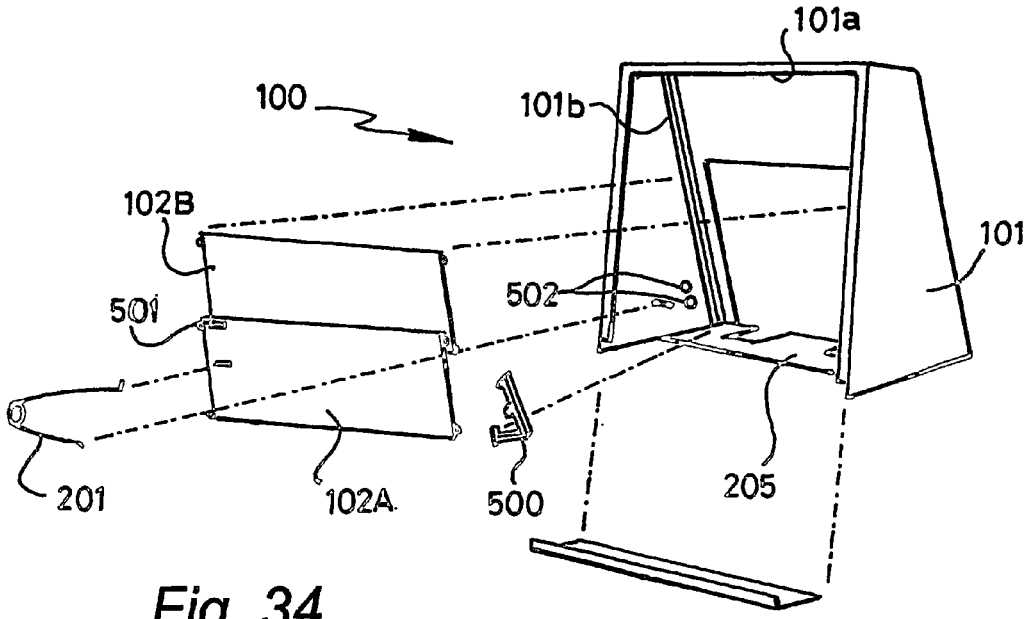
FIG. 34 shows an exploded isometric rear view of the cover shown in FIG. 33.

One such arrangement is shown in FIGS. 33 and 34 where a detachable cover (100) is shown comprising a frame (101) and a sliding cover panel (102). The frame (101) is mountable on the wall (not shown) by locating inwardly turned lips (101*a*) behind the faceplate of a socket (not shown).

The cover panel (102) comprises a pair of panel members (102A, 102B) slidably mounted between side walls of the frame (101). This is not essential and the panel (102) may comprise one or more panel members as desired.

The panel members (102A,102B) are shown in a closed position in FIG. 33 covering the faceplate. The panel members (102A,102B) are biased to an open position (not shown) allowing access to the faceplate of the socket by a spring (201) acting between the frame (101) and the lower panel member (102A).

The lower panel member (102A) is secured in the closed position by a latch mechanism similar to that shown and described with reference to FIGS. 28*a-c* and like reference numerals are used to indicate corresponding parts. The operation of the latch mechanism will be understood from the description of FIGS. 28*a-c* and is not repeated.

The cover panel members (102A,102B) are guided for sliding movement in inwardly facing grooves (101*b*) in the sidewalls of the frame (101) and the lower panel member (102A) is designed to "pick-up" the upper panel member (102B) as it moves to the open position under the biasing of the spring (201).

In this way, the cover panel (102) "concertinas" to reduce in size in the open position and can be confined within the frame (101). The number of panel members (102A, 102B) may be chosen as desired.

The frame (101) has a base plate (205) with openings for passage of cable leads and cable ties (not shown) may be provided as described previously so that pulling forces applied to the cables are transferred to the frame (101) away from the cover panel (102).

It will be understood that the concept of a sliding cover panel can be applied in a variety of different ways and the invention is deemed to include all such arrangements. It will also be understood that the cover may employ similar latching arrangements to those described herein with modification as appropriate to adapt the mechanisms for sliding movement of the cover panel(s) in place of the hinging movement of the previous embodiments.

As described herein, at least some embodiments of the invention provide a lockable cover that is "built-in" to the socket, either as an integral part thereof or separate but permanently secured thereto (otherwise referred to as the detachable accessory socket).

Thus, for use with an apertured terminal-carrying plate mounted on a box (perhaps itself flush mounted on or within a cavity in a wall for wall mounted sockets or free-standing in the case of extension sockets), the invention proposes a socket with integral lockable cover with a frame that is either formed integrally with the socket plate, or is formed separately and permanently attached to the socket plate, and a latchable cover panel hingedly secured to the frame so as completely to cover the switch or socket and any plug therein when closed.

Such detachable accessory socket with integral cover may be used for new build and when adding sockets to an existing circuit or to replace an unprotected socket in an existing circuit. Other embodiments provide a lockable cover that is detachable from the socket and can be fitted to an existing socket.

At least some embodiments of the invention also provide double latching arrangements for securing the cover panel in the closed position that can be employed with both the integral and detachable versions of the cover. Furthermore, some embodiments of the invention provide a detachable cover with a frame that extends around the perimeter of the socket plate and is held in place by the socket plate.

It will be understood that the invention is not limited to the embodiments above-described. For example, any of the latching mechanisms described herein may be employed in combination with any of the integral (built-in) covers and separate, detachable covers described herein and all such combinations are within the scope of the invention.

A particular advantage of the latching mechanisms described herein is that they allow single handed operation both for opening and closing the cover panel. Thus the cover panel is automatically latched on being pushed to the closed position and, where key-operated, rotation of the key can be sufficient to release fully the cover panel, even with those arrangements employing a double latch to secure the cover panel.

Other changes that can be made without departing from the principle or concept of the invention will be apparent to those skilled in the art.

Moreover, features of any of the embodiments described herein may be employed separately or in combination with any other features and the scope of the invention is to be construed accordingly.

The invention claimed is:

1. A socket comprising a face plate provided with a plug receiving socket and at least one hinged cover panel, said at least one cover panel being movable about at least one hinge between a closed position concealing the plug receiving socket and an open position providing access to the plug receiving socket, said at least one cover panel defining an enclosure sized to accommodate a plug inserted in the plug receiving socket such that the plug is concealed behind said at least one cover panel in the closed position, said enclosure having at least one aperture through which a cord associated with said plug exits said enclosure in the closed position, said hinge being disposed on a first side of said enclosure, a latch means disposed on a second side of said enclosure, said latch means holding said at least one cover panel in the closed position in which said at least one aperture is not in said first side or said second side of said enclosure, the latch means being self-latching on movement of said at least one cover panel towards the closed position to secure automatically said at least one cover panel in the closed position, an actuator means for releasing said at least one cover panel, and a spring means biasing said at least one cover panel away from the closed position to move automatically said at least one cover panel to the open position when the latch means is released, and wherein the face plate and the at least one cover panel form an integral unit for connecting to a mounting box with said at least one cover plate attached to the face plate by said at least one hinge.

2. A socket according to claim 1 wherein said at least one cover panel is movably mounted with respect to a frame that extends around a marginal edge of the face plate and is integral with the face plate between the closed position, where the cover panel completely covers and encloses the face plate, and the open position, allowing access thereto.

3. A socket according to claim 2 wherein the latch means comprise a catch part engaging with a retainer part, and one of said parts is on or adjacent an edge of the cover panel and engages with the other part on or in the frame.

4. A socket according to claim 3 wherein one of said parts is resilient and can be deflected to engage the other part automatically when the cover panel is moved from the open position to the closed position and is deflected to disengage the other part by an electric actuator.

5. A socket according to claim 3 wherein one of said parts is resilient and can be deflected to engage the other part automatically when the cover panel is moved from the open position to the closed position, and is deflected to disengage the other part by a key operated release means.

6. A socket according to claim 5 wherein the resilient part is deflected to disengage the other part by rotational movement of the key operated release means.

7. A socket according to claim 5 wherein the resilient part is deflected to disengage the other part by axial sliding movement of the key operated release means.

8. A socket according to claim 5 wherein the key operated release means includes at least one formation insertable through an opening in the frame to engage the resilient part.

9. A socket according to claim 8 wherein the opening is protected by a movable shutter.

10. A socket according to claim 5 wherein the latch means comprises first and second latches that are engaged to hold said at least one cover panel in the closed position and are released by the key operated means to allow said at least one cover panel to move to the open position.

11. A socket according to claim 10 wherein the first and second latches are engaged and disengaged in sequence.

12. A socket according to claim 11 wherein the first and second latches are engaged in response to movement of said at least one cover panel in different directions relative to the frame.

13. A socket according to claim 12 wherein one latch is engaged by relative axial movement parallel to a hinge axis of the cover panel and the other latch is engaged by relative rotational movement about the hinge axis.

14. A socket according to claim 13 wherein said one latch is engaged first on closing said at least one cover panel and said other latch is released first on opening said at least one cover panel.

15. A socket according to claim 14 wherein means is provided to block relative axial movement parallel to the hinge axis in a direction to release said one latch when said other latch is engaged in the closed position.

16. A socket according to claim 15 wherein said blocking means includes a guide face to assist relative movement of said at least one cover panel.

17. A socket according to claim 15 wherein on release of said other latch, said one latch allows relative rotational movement of said at least one cover panel and frame to clear said blocking means and permit relative movement parallel to the hinge axis to release said one latch.

18. A socket according to claim 17 wherein said at least one cover panel is biased in a direction parallel to said hinge axis and is movable against the axial biasing to release said one latch.

19. A socket according to claim 2 further comprising a cable exit means including an opening in the frame for passage of a cable lead.

20. A socket according to claim 19 wherein the cable exit means comprises a cable tie arranged to transmit pulling forces applied to the cable lead to the frame.

* * * * *